US007908810B2

(12) United States Patent
Payne, Jr. et al.

(10) Patent No.: US 7,908,810 B2
(45) Date of Patent: Mar. 22, 2011

(54) CORRUGATED STEEL DECK SYSTEM INCLUDING ACOUSTIC FEATURES

(75) Inventors: Stephen W. Payne, Jr., Wildwood, IL (US); Kurt Goodfriend, Oak Park, IL (US); David Bruce McDonald, Glenview, IL (US); Dennis A. Socha, Buffalo Grove, IL (US); John Ellicson, McHenry, IL (US); Francis H. Laux, Wheeling, IL (US); Russell A. Dombeck, Salem, WI (US); Thomas F. Sheppard, Crystal Lake, IL (US)

(73) Assignee: United States Gypsum Company, Chicago, IL (US)

( * ) Notice: Subject to any disclaimer, the term of this patent is extended or adjusted under 35 U.S.C. 154(b) by 736 days.

(21) Appl. No.: 11/170,738

(22) Filed: Jun. 30, 2005

(65) Prior Publication Data

US 2007/0000198 A1 Jan. 4, 2007

(51) Int. Cl.
*E04F 15/02* (2006.01)
*E04F 15/022* (2006.01)
*E04F 15/10* (2006.01)

(52) U.S. Cl. ..... 52/450; 52/480; 52/145; 52/236.5; 52/745.05

(58) Field of Classification Search ..... 52/450, 52/403.1, 480, 407, 384, 144, 145, 612, 236.5, 52/236.6, 236.8, 745.05, 745.08
See application file for complete search history.

(56) References Cited

U.S. PATENT DOCUMENTS 1,178,210 A 4/1916 Brinckerhoff
3,763,614 A 10/1973 Hyde et al.
3,956,864 A * 5/1976 Fung ..... 52/414
4,276,730 A 7/1981 Lewis
4,492,064 A * 1/1985 Bynoe ..... 52/309.8
4,609,305 A 9/1986 Groeneveld
4,681,786 A 7/1987 Brown
4,685,259 A * 8/1987 Eberhart et al. ..... 52/144
4,747,247 A 5/1988 Petersen, Jr. et al.

(Continued)

FOREIGN PATENT DOCUMENTS

DE 3415848 10/1985

(Continued)

OTHER PUBLICATIONS

MAXXON, The Floor Specialists, "Acousti-Mat® II Data Sheet" [online]. [retrieved on May 5, 2005]. Retrieved from the Internet:<URL: http://www.gypcrete.com/product_detail.asp?ID=9>.

(Continued)

*Primary Examiner* — Phi Dieu Tran A
(74) *Attorney, Agent, or Firm* — Novak Druce + Quigg LLP; Philip T. Petti; Pradip K. Sahu

(57) ABSTRACT

The present invention relates to a sound rated floor system for inhibiting sound transmission between floors. The system includes a corrugated steel deck; a first layer of cementitious material or board or sheet applied over the corrugated steel deck; a sound insulation mat or board applied over the first layer; a second layer of cementitious material applied over the sound insulation mat or board. The floor system has an IIC rating of at least 25 and the corrugated steel deck provides at least 50 percent of the ultimate load carrying capacity under static and impact loading of the floor system with a floor deflection of at most 1/360 of the floor span.

37 Claims, 7 Drawing Sheets

U.S. PATENT DOCUMENTS

| | | | | | |
|---|---|---|---|---|---|
| 4,879,856 | A | * | 11/1989 | Jones et al. | 52/403.1 |
| 4,909,003 | A | * | 3/1990 | Hennigan | 52/144 |
| 5,016,411 | A | * | 5/1991 | Thorsnes | 52/220.4 |
| 5,119,606 | A | | 6/1992 | Graham | |
| 5,782,047 | A | * | 7/1998 | De Quesada | 52/236.6 |
| 5,787,668 | A | * | 8/1998 | Carkner et al. | 52/408 |
| 5,842,314 | A | * | 12/1998 | Porter | 52/309.7 |
| 5,867,957 | A | * | 2/1999 | Holtrop | 52/403.1 |
| 5,884,446 | A | | 3/1999 | Hageman | |
| 5,992,110 | A | | 11/1999 | Clear | |
| 6,226,942 | B1 | * | 5/2001 | Bonin | 52/309.12 |
| 6,244,008 | B1 | * | 6/2001 | Miller | 52/602 |
| 6,298,617 | B1 | * | 10/2001 | de Quesada | 52/236.3 |
| 6,319,579 | B1 | | 11/2001 | Strandgaard | |
| 6,691,482 | B1 | * | 2/2004 | Ault | 52/450 |
| 6,705,055 | B2 | | 3/2004 | Ritter et al. | |
| 6,729,094 | B1 | | 5/2004 | Spencer et al. | |
| 6,755,001 | B2 | * | 6/2004 | Eaton | 52/506.06 |
| 2003/0188921 | A1 | | 10/2003 | Kakimoto et al. | |
| 2004/0059027 | A1 | | 3/2004 | Steffonson | |

FOREIGN PATENT DOCUMENTS

| | | |
|---|---|---|
| EP | 0102120 | 3/1984 |
| EP | 0260911 | 3/1988 |
| FR | 2745021 | 8/1997 |
| GB | 2279676 | 1/1995 |

OTHER PUBLICATIONS

MAXXON, The Floor Specialists, "Acousti-Mat® 3 Data Sheet" [online]. Copyright 2001. [retrieved on May 5, 2005]. Retrieved from the Internet:<URL: http://www.gypcrete.com/product_detail.asp?ID=10>.

GypsumSolutions.com, The Industrial Products Division of United States Gypsum Company, "USG LEVELROCK™ Brand" [online]. [retrieved on May 5, 2005]. Retrieved from the Internet:<URL:http://gypsumsolutions.com/brand.asp?prod=79>.

GypsumSolutions.com, The Industrial Products Division of United States Gypsum Company, "Levelrock® Brand SRM-25" [online]. [retrieved on May 5, 2005]. Retrieved from the Internet:<URL:http://www.gypsumsolutions.com/brand.asp?prod=80>.

Roof Deck, Inc., "LOK-1.5 Composite Floor Deck", Thursday, May 5, 2000, [online]. [retrieved on May 5, 2005]. Retrieved from the Internet:<URL:http://roofdeckinc.com/catalog/1.5-light.htm> pp. 1-3.

James River Steel, Corrosion Resistant Metals for Corrosive Environments, Type "B" Wide Rib Panel Decking [online]. [retrieved on May 30, 2005]. Retrieved from the Internet:<URL:http://www.jamesriversteel.com/deck4.htm> pp. 1-2.

UL Underwriters Laboratories, Inc., "BXUV.G551 Fire Resistance Ratings—ANSI/UL 263" [online]. [retrieved on May 30, 2005]. Retrieved from the Internet:<http://database.ul.com/cgi-bin/XYV/template/LISEXT/1FRAME/showpage.html?name=BXUV.G551&ccnshorttitle=Fire+Resistance+Ratings+-+ANSI/UL+263&objid=1077214332&cfgid=1073741824&version=versionless&parentid=1073984818&sequence=1>.

UL Underwriters Laboratories, Inc., "BXUV.G505 Fire Resistance Ratings—ANSI/UL 263" [online]. Aug. 28, 2003 [retrieved on May 5, 2005]. Retrieved from the Internet:<http://www.pac-intl.com/ul/G505.htm> pp. 1-5.

National Research Council Canada, "Specifying Acoustical Criteria for Buildings" [online]. Construction Technology Update No. 50, Jun. 2001 [retrieved on May 5, 2005]. Retrieved from the Internet:<http://irc.nrc-cnrc.gc.ca/pubs/ctus/50-pring_e.html> pp. 1-7.

"RSIC Acoustic Assembly, Noise Control Wall Assembly", Pac International, Inc., Product Description, (date of document prior to Jun. 30, 2005).

"The Sound of Silence, The Noise S.T.O.P.™ RSIC-1 Resilient Sound Isolation Clip", Acoustical Surfaces, Inc., Product Description, (date of document prior to Jun. 30, 2005).

"Enkasonic® Sound Control Matting", Enka-Engineered Building Products, Product Description, (date of document prior to Jun. 30, 2005).

"Enkasonic® 9110", Colbond, Product Description (date of document prior to Jun. 30, 2005).

* cited by examiner

CORRUGATED STEEL DECK SYSTEM INCLUDING ACOUSTIC FEATURES

FIELD OF THE INVENTION

The present invention relates to a sound rated floor system for inhibiting sound transmission between floors. In particular, the sound rated floor system comprises from the top down a layer of poured cementitious material, e.g., cement or concrete, an acoustical mat, an optional leveling layer, and a corrugated steel deck. The floor system transfers loads including shear resistance and vertical load carrying capabilities. The deck may be typically supported on light-gage steel joists. An optional ceiling and insulation may be provided. The invention further relates to a method of construction of a sound rated floor system.

BACKGROUND OF THE INVENTION

A commonly used floor/ceiling system uses wood decks placed over wood joists. These systems may include insulation and layers of gypsum drywall attached to the joist using acoustical channels. To provide improved acoustical performance, these decks are frequently covered with a mat with acoustical properties such as USG LEVELROCK Brand SRB (sound reduction board) or USG LEVELROCK Brand SRM-25 (sound reduction mat), and a poured gypsum underlayment such as USG LEVELROCK Brand underlayment. One limitation of these wood systems is that they cannot be used in structures requiring "non-combustible design," such as some multi-story residential and commercial buildings, schools and hospitals.

To provide a "non-combustible design," a common floor/ceiling system includes construction using steel deck systems over steel framing. These typically involve a design using a system of corrugated steel decking, designed using steel properties provided by the Steel Deck Institute (SDI) applied over steel joists and girders. The steel deck is then covered with concrete. The concrete is typically 2-4 inches thick and reinforced with reinforcing steel. The concrete provides additional strength to the floor to permit it to carry design loads and limit floor deflections. A ceiling, such as gypsum drywall mounted on DIETRICH RC DELUXE channels may be attached to the bottoms of the joists or ceiling tiles and grid may be hung from the joists. An alternate is for the bottom surfaces of the steel to be covered with spray fiber or fireproofing materials. Limitations of these systems include increased construction times due to placement and curing of the lightweight concrete, lower acoustical performance, and overall weight of the system.

In existing systems, the concrete is used with the steel deck and joists to provide the flexural and diaphragm strengths required for the structure. The designs cannot accommodate the full design load capacity until after the concrete has fully cured, which is normally a period of up to 28 days. Load restrictions may be in place until after 28 days. The concrete also is required to be cured, which may involve the placement of wetted burlap on the floor or the addition of a curing compound on the floor. Additional details of curing are documented by the American Concrete Institute Committee 308 "Standard Practice for Curing Concrete" (ACI 308, American Concrete Institute, Farmington Hills, Mich.) If used, curing blankets and films, often left for up to 7 to 14 days after concrete placement, prohibit trades persons from getting back on the job for work, such as installation of gypsum wallboard.

Floor sound ratings are typically evaluated in a laboratory by ASTM Standards E492 or and E989 and are rated as to impact insulation class (IIC). The greater the IIC rating, the less impact noise will be transmitted to the area below. In general, impact sound is generated due to pedestrian footfall on the floor, movement of heavy objects over the floor and any other contact made with the floor.

Floors may also be rated as to Sound Transmission Class (STC) using ASTM E90. The greater the STC rating, the less airborne sound will be transmitted to the area below. Airborne sound is usually due to speech or music.

The acoustic performance with respect to Impact Insulation Class (IIC) of typical metal deck systems with a ceiling including 4 inches of concrete over steel decking is generally poor, rating frequently less than 35. Without a ceiling these systems would provide IIC ratings frequently less than 25. A poor rating particularly results if the flooring is covered with hard surfacing, such as ceramic tile, wood or vinyl.

The use of carpeting is one approach taken to addressing the problem of the transmission of impact sound between floors in multistory dwellings and commercial buildings. However, this is not always practical. An alternative to the use of carpeting to prevent impact sound transmission has been the use of a floating floor or other sound rated floor system. Ceilings may also be adjusted to improve the impact sound performance of a floor. These may be attached using various clips or channels including RC1, PAC-international RSIC, DWSS or various other systems to provide sound isolation.

Sound rated floors typically are required by building codes to have an IIC rating of not less than 50 and an STC rating of not less than 50. Even though an IIC rating of 50 meets many building codes, experience has shown that in luxury condominium applications, even floor-ceiling systems having an IIC of 56-57 may not be acceptable because some impact noise is still audible. Every 10 points of increase in IIC rating represents a doubling of performance and would sound half as audible to the human ear.

Also, a sound rated floor must have enough strength and stiffness to limit the potential for cracking and deflection of the finished covering. At the same time, the sound rated floor should be resilient enough to isolate the impact noise from the area to be protected below.

Also, a sound rated floor with a relatively low profile is preferred to maintain minimum transition heights between a finished surface of the sound rated floor and adjacent areas, such as carpeted floors, which by themselves may have sufficiently high IIC ratings.

U.S. Pat. No. 4,685,259 discloses a sound rated flooring which comprises a sound attenuation layer placed on a subfloor. The panel structure has a core and at least one acoustically semi-transparent facing of fibrous material bonded to the core and a rigid layer on the sound attenuation layer. The core of the panel structure is a walled structure such as a honeycomb formed of cardboard, kraft paper or aluminum. The facing placed on the core is a fibrous material such as glassfiber. A rigid layer is placed on top of the attenuation layer to support the upper finished flooring.

In a floating floor system, an intervening sound isolating layer is incorporated between the top finish surface and the floor joists. U.S. Pat. No. 4,879,856 discloses a floating floor system for use with joist floors. Inverted channel section floor supports are mounted longitudinally on the floor joists. The inverted channel has outwardly directed flanges between the joists. Sound insulation material is interposed on the outward directed flanges between the joists. The flooring is extended over the insulation material and secured to the joists.

U.S. Pat. No. 4,681,786 discloses a horizontal-disassociation-cushioning layer underneath a tile floor. The horizontal-disassociation-cushioning layer is a sheet of elastic foam from about ⅛ to ½ inch thick used to diminish the transmission of impact sound to the area below the floor.

Isolation media for use in sound rated floors also include USG LEVELROCK brand sound reduction board, USG LEVELROCK brand sound reduction mats, and MAXXON ACOUSTI-MAT II or ACOUSTI-MAT III brand sound reduction mats. In a typical use, the mat or board is laid over an entire concrete or wood subfloor. Then isolation strips are installed, and then taped around the perimeter of the entire room, to eliminate flanking paths. Then seams between sections of the sound reduction mat or board are adhered with zip-strips or taped. Then the sound reduction mat or board is covered with ¾ to one -inch (18 to 25 mm) of an underlayment such as LEVELROCK brand floor underlayment. To ensure uniform depth and a smooth finish, installers may use a "screed" to finish the underlayment surface.

SUMMARY OF THE INVENTION

The present invention relates to a floor system and a method for constructing this floor system. Typically, the floor system has an IIC rating of at least 25, preferably at least 30, even in the absence of a ceiling. With various ceiling configurations, this invention reduces impact noise levels to meet building codes and performance needs, to greater than 40, preferably greater than 45, more preferably greater than 50.

The floor system of the present invention includes a corrugated steel deck; an optional lower leveling layer of a member selected from the group consisting of cementitious material, leveling board and sheet, applied over the corrugated steel deck; a sound insulation mat or board applied over the first lower layer; an upper layer of cementitious material applied over the sound insulation mat or board; wherein the lower leveling layer (if present) has a thickness of about 0 to 1.5 inches (0 to 3.8 cm) above a flute of the corrugated steel deck span. If the lower layer is provided as cementitious material, it fills the decking flutes.

The sound insulation mat is placed within 0 to 1-½ inch (0 to 3.8 cm), or preferably 0-½ inch or most preferably 0-⅛ inch from the top of the corrugated steel deck. Typically, if the cementitious material is provided to be level with the deck flutes, the sound insulation mat is placed within 0 in. from the top of the corrugated steel decking. The corrugated steel deck provides at least 50 percent, preferably greater than 70, or most preferably greater than 90 percent of the ultimate static and impact load carrying capacity of the floor system with a floor deflection of at most 1/360 of the floor span.

The layer of insulation and layers of cured cementitious material, board or steel sheet do not contribute to the design capacity of the floor. The deck may be typically supported on lightweight steel C-joists or steel trusses or open-web bar joists. An optional ceiling may be provided by being attached to the joists or a suspended ceiling may be provided under the joists.

The invention further relates to a method of construction of a floor system comprising applying an optional lower leveling layer of cementitious material, e.g., cement or concrete, or board or sheet (typically steel sheet) to corrugated steel deck to cover the flutes; applying a sound insulation mat or board over the lower layer (or if the lower layer is not present applying the sound insulation board directly to the corrugated steel deck); and applying an upper surface layer of cementitious material, e.g., cement or concrete, over the sound insulation mat or board. Typically, the floor system has an IIC rating of at least 25, preferably at least 30, even in the absence of a ceiling. Typically, the sound insulation mat or board is to be placed within 0 to 1-½ in. (0 to 3.8 cm), or preferably 0-½ in., or most preferably 0-⅛ in. from the top of the corrugated steel decking.

Typically, where the first layer of cementitious material is employed to fill level with the top of the flutes, the sound insulation mat or board is placed within 0 in. from the top of the corrugated steel decking. Typically, the corrugated steel deck provides at least 50 percent, or preferably greater than 70 percent, and most preferably greater than 90 percent of the ultimate static and impact load carrying capacity of the floor system with a floor deflection of at most 1/360 of the floor span. With various ceiling configurations, this invention reduces impact noise levels to meet building codes and performance needs, to greater than 40, preferably greater than 45, more preferably greater than 50.

The corrugated steel decking is typically designed using steel properties provided by the Steel Deck Institute (SDI) applied over steel joists or girders. The conventional 2-4 inch thick layer of concrete that typically is poured onto the steel decking is replaced with an underlayment of acoustical insulation covered by poured cementitious material. This reduces overall flooring weight and achieves good sound insulation.

The new design may use heavier gage steel deck than would be used with the conventional layer of concrete. Unlike traditional design of steel deck systems, which frequently rely on the concrete layer to share in the load carrying capacity with the steel decking to meet structural design loads, the present steel deck is designed to accommodate all structural design loads.

The lower layer of cementitious material (if present) and upper layer of cementitious material, for example LEVELROCK® Brand Floor Underlayment, are used as a non-structural floor fill. The metal deck is designed for at least the majority of structural loads (gravity & lateral loads). Thus, the floor system is not designed as a conventional composite action floor system, in that the cementitious material is not used to transfer significant diaphragm shear forces or gravity forces for the main structural system.

The present floor system may have a lower unit weight than a floor system of open web bar joists, metal deck and poured in place concrete or precast plank with a topping slab on load bearing walls. Unit weight is defined as the unit weight of a floor system in lbs/sq. ft. to satisfy all serviceability and strength requirements for a particular span and loading condition. Strength in this definition includes flexural strength, shear strength and compressive strength, for both vertical and/or horizontal (transverse) loads on the floor. Vertical and horizontal loads include typical structural live and/or dead loads, which may be generated by such forces as gravity, wind, or seismic action.

For instance, a comparison can be made of systems including a 20 foot span designed to withstand live loads of 40 pounds per square foot with a floor deflection under this load in inches calculated as less than ((20 feet×12 inches/foot)/360) inches, i.e., 0.667 inches. An embodiment of the present system having floor diaphragm comprising a horizontal diaphragm, having from bottom to top a corrugated metal deck, a first layer of cementitious material having a thickness level with the top of the flute of the corrugated metal deck, a layer of sound insulation mat, and a second layer of cementitious material having a thickness of one inch, installed on a 20 foot span of lightweight steel C-joists, should have having a lower unit weight than a 20 foot span floor system of lightweight steel C-joists, installed below a floor diaphragm of corrugated metal deck and a four inch thick concrete slab.

As mentioned above, in the invention the corrugated steel deck generally provides at least 50 percent, or preferably greater than 70 percent, and most preferably greater than 90 percent of the ultimate static and impact load carrying capacity of the floor system with a floor deflection of at most 1/360 of the floor span. This means that floor dead loads are primarily carried by the steel decking alone, supported on joists and structural elements. For example, in a hypothetical system wherein the corrugated steel deck provides 70 percent of the ultimate load carrying capacity of the floor system with a floor deflection of at most 1/360 of the floor span, a floor having only the corrugated steel deck on joists will support 70 percent of the load with a floor deflection of 1/360 of the floor span as would the complete floor system having a sound mat between the first and second cementitious layers.

The lower cementitious leveling layer fills the corrugations of the steel decking and provides a level upper surface to which the acoustical mat will be applied. The lower cementitious leveling layer may be made of any pourable cementitious underlayment that does not contain materials harmful to steel decking. Harmful materials would be those that may corrode or deteriorate the underlying steel decking. Alternatively, the deck may be coated or otherwise protected against deterioration using organic, metallic or inorganic coatings to prevent contact between the two materials. Suitable cementitious materials include any of gypsum cement, hydraulic cement, Portland cement, high alumina cement, pozzolanic cement, lightweight concrete or mixtures thereof. A typical poured cement has 25 weight % Portland cement, 75 weight % gypsum based cement, 2 parts by weight sand per 1 part by weight cement and 20 parts by weight water added per 100 parts by weight solids. The lower cementitious leveling layer has a thickness of 0-1-½ inch (0 to 3.8 cm), preferably 0-½ inch, most preferably 0-⅛ inch from the top of the deck flutes. Typically the lower leveling layer has a thickness of about 0.15 to 1.5 inches, or about 0.15 to ⅜ inches, or about 0.15 to ¼ inches, above the flute of the corrugated steel deck. If the cementitious material fills the flutes to be even with the topus of the flutes, then the lower leveling layer has a thickness of about 0 inch above the flutes.

This lower layer may be reinforced using continuous strands, cut or chopper fibers that may be made of organic, inorganic or metallic materials including alkali resistant or coated glass, steel, carbon fiber, Kevlar strand.

The embedded acoustical material may include any mat or board that provides decoupling of acoustic noise. The mat or board should increase the IIC of the assembly by >4, preferably >7 and most preferably >10 IIC points in a given assembly.

The upper cementitious surface layer may be of the same or different from the material for the lower cementitious leveling layer. The upper surface layer provides a sturdy level surface. The upper surface layer is typically about 0.5 inches to 3 inches, preferably 0.5 to 1.5 inches thick, typically about 1 inch thick. The upper cementitious surface layer may optionally be reinforced with organic, inorganic or metallic strands including steel, glass or polymer reinforcement. For example, typical reinforcing material includes expanded metal lath or products such as COLBOND 9010 mat or MAPELATH polymer lath from Mapei. The upper layer may also be reinforced using cut or chopper fibers that may be made of organic, inorganic or metallic materials including alkali resistant or coated glass, steel, carbon fiber, KEVLAR strand.

A ceiling may also be attached to further improve acoustical performance. Typical ceilings may be constructed from gypsum wallboard or ceiling tile. These may be attached to the joists using acoustic isolators, such as DIETRICH RC DELUXE resilient channels or hat channels with Pac-International RSIC-1 resilient sound isolation clips or similar, or the ceilings may be drywall suspension systems hung below the joists.

Optionally, further improved acoustic performance may be obtained by including mineral wool or glassfiber insulation between the joists in the ceiling.

Embodiments which omit the first layer comprise (from the bottom): a corrugated steel deck; a sound insulation board applied over the deck that has sufficient resilience to span between flutes of the corrugated deck; and an upper layer of cementitious material applied over the sound insulation mat or board. The upper surface layer is typically about 0.5 inches to 3 inches, preferably 0.5 to 1.5 inches thick, typically about 1 inch thick. Generally the floor system has an IIC rating of at least 25, preferably at least 30, even in the absence of a ceiling. Typically, the corrugated steel deck generally provides at least 50 percent, or preferably greater than 70 percent, and most preferably greater than 90 percent of the ultimate static and impact load carrying capacity of the floor system with a floor deflection of at most 1/360 of the floor span.

A potential advantage of the present system is that, due to its being lightweight and strong, the combination of the present floor system permits efficient use of building volume for a given building footprint to permit maximization of building volume for the given building footprint. Thus, the present system may allow for more efficient building volume to allow more floor to ceiling height or even a greater number of floors in zoning areas with building height restrictions.

The lightweight nature of this system reduces the dead load associated with conventional corrugated steel pan deck/poured concrete systems. Less dead load also addresses sites with soils with relatively low bearing capacities.

The invention also provides a sound rated light economical replacement for flooring systems constructed with a thick layer of poured concrete on a metal pan deck.

An additional advantage of the invention is an increased speed of construction using reduced labor. The assembly may be completed and be serviceable and allowing design loads within 2 to 10 days of the placement of the steel decking, compared with over 28 days using standard concrete deck systems. A crew of 6 people may be able to place up to 30,000 sq ft of flooring in a structure within a single day.

BRIEF DESCRIPTION OF THE DRAWINGS

In the drawings like elements are identified with like reference numbers.

DETAILED DESCRIPTION OF THE INVENTION

Figure 1:
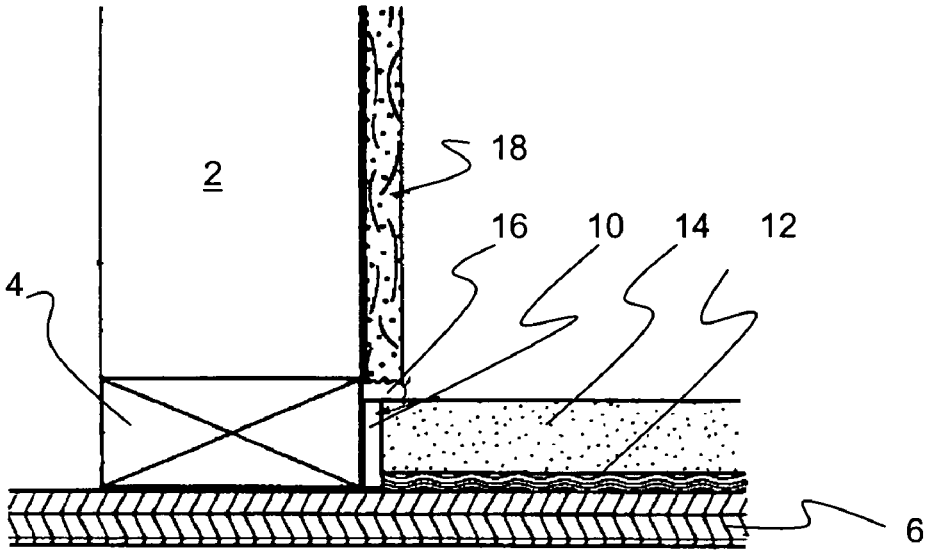
Fig. 1 (Prior art)
FIG. 1 shows a first embodiment of a conventional floor employing underlayment poured over an upper surface of a sound reduction mat.

FIG. 1 shows a typical embodiment of a conventional construction system. The system places a wall having vertical wood or steel studs 2 attached to a horizontal base plate 4 on a wood or concrete subfloor 6. Unlike the present system, a subfloor 6 if made of concrete provides significant strength to the floor. Then the base of the perimeter of the walls is lined with a perimeter isolation strip 10, for example, LEVELROCK Brand perimeter isolation strip. A layer of sound reduction mat 12, for example ¼ inch thick LEVELROCK Brand SRM-25 sound reduction mat, is placed over the subfloor 6 but separated from the wall base plate 4 by the perimeter isolation strip 10. A layer of floor underlayment 14, for example a 1 inch (2.5 cm) minimum thick layer of LEVELROCK Brand floor underlayment, is poured over the layer of sound reduction mat 12. Then a layer of flexible acoustic caulk 16 is placed on the perimeter of the upper surface of the layer of underlayment 14 and the wall studs 2 are covered with a layer of wallboard 18, for example ½ inch or ⅝ inch (1.3 cm or 1.6 cm) SHEETROCK Brand gypsum panels.

Figure 2:
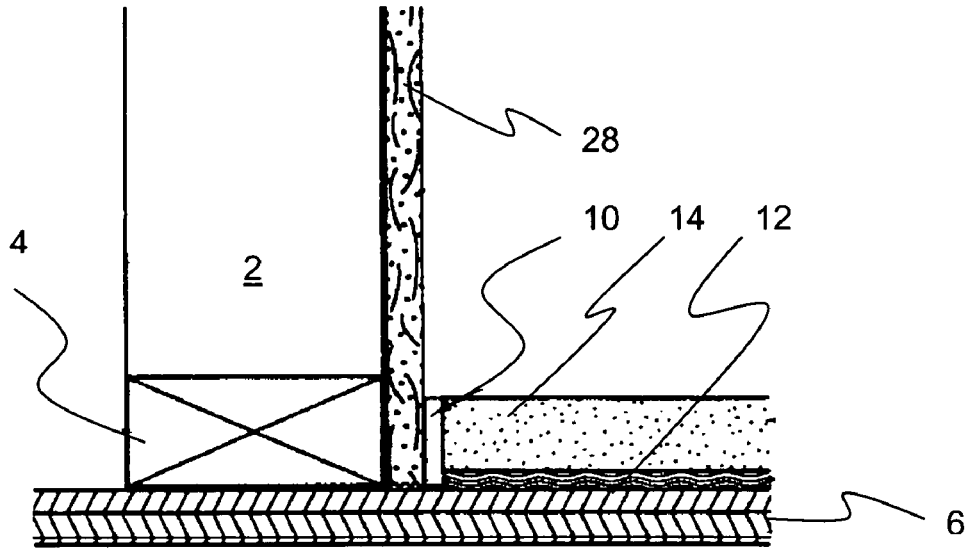
Fig. 2 (Prior art)
FIG. 2 shows a second embodiment of a conventional floor employing underlayment poured over the upper surface of a sound reduction mat).

FIG. 2 shows a typical embodiment of a second conventional construction system. The system places a wall having vertical studs 2 attached to a horizontal base plate 4 on a wood or concrete subfloor 6 and the wall studs 2 are covered with a layer of wallboard 28, for example ½ inch or ⅝ inch SHEETROCK Brand gypsum panels. Then the lower perimeter of the wallboard 28 is lined with a perimeter isolation strip 10, for example, LEVELROCK Brand perimeter isolation strip. A layer of sound reduction mat 12, for example ¼ inch thick LEVELROCK Brand SRM-25 sound reduction mat, is placed over the subfloor 16 but separated from the walls by the perimeter isolation strip 10. A layer of floor underlayment 14, for example a 1 inch minimum thick layer of LEVELROCK Brand floor underlayment, is poured over the layer of sound reduction mat 12.

Figure 3:
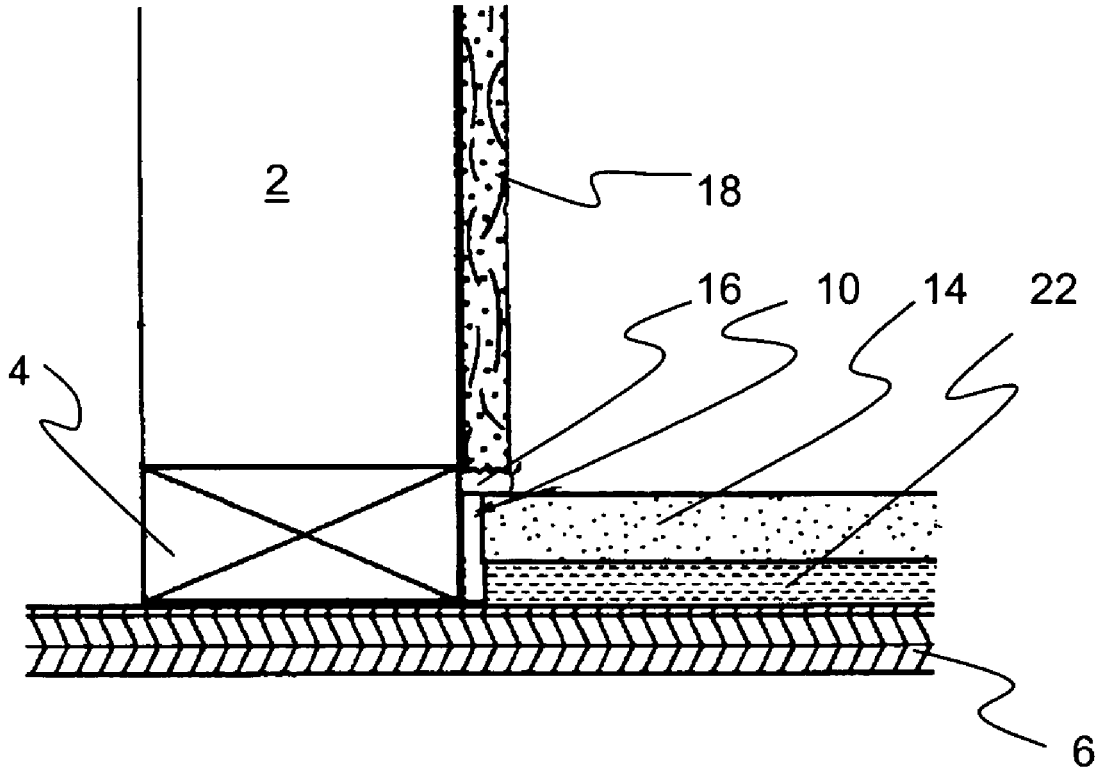
Fig. 3 (Prior art)
FIG. 3 shows a third embodiment of a conventional floor employing underlayment poured over the upper surface of a sound reduction board.

FIG. 3 shows a typical embodiment of a third conventional construction system. Which is substantially the same as that of FIG. 1 except the sound reduction mat 12 is replaced by a sound reduction board 22, for example a ⅜ inch thick layer of LEVELROCK Brand SRB sound reduction board. A layer of floor underlayment 14, for example a ¾ inch minimum thick layer of LEVELROCK Brand floor underlayment, is poured over the layer of sound reduction board 22.

Figure 4:
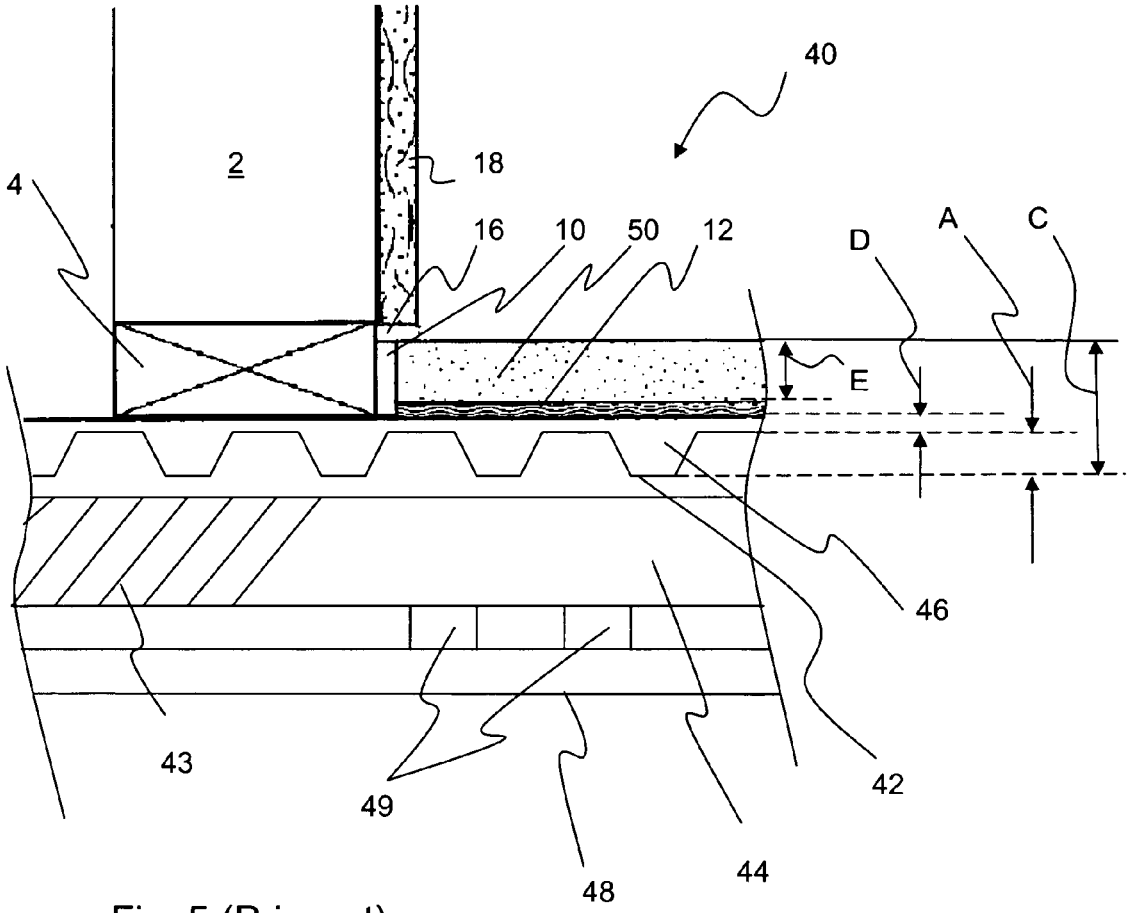
FIG. 4 shows a first embodiment of a floor of the present invention employing a first layer of underlayment poured over the upper surface of a corrugated steel deck, a layer of sound reduction mat placed over the first layer of underlayment, and a second layer of underlayment poured over the upper surface of the layer of the sound reduction mat.

FIG. 4 shows a first embodiment of a floor 40 of the present invention. This embodiment includes a corrugated steel deck 42 applied over steel joists or girders 44 (one shown). The corrugated steel deck 42 rests on the steel joists or girders 44, but FIG. 4 shows the corrugated steel deck 42 slightly spaced the steel joists or girders 44 to more easily see the corrugated steel deck 42. A typical embodiment of steel decking has a deck flute "A" of about 9/16 in. (FIG. 4). The base plate 4 and studs 2 are located to define the floor perimeter. A first lower leveling layer of cementitious material 46, for example LEVELROCK Brand Floor underlayment, is poured over the upper surface of the corrugated steel deck 42. This first lower leveling layer of cementitious material 46 typically has a thickness "D" of about 0 to 1.5 inches (0 to 3.8 cm), preferably 0 to ⅛ inches (0 to 0.3 cm), typically about 0 inch (0 cm) above the flute of the corrugated steel deck 42, which is substantially level with the flute of the corrugated steel deck 42.

The first layer of cementitious material 46 is allowed to harden sufficiently for tradespersons to walk on it, typically a compressive strength greater than 500 psi, preferably a compressive strength greater than 1000 psi and most preferably with a compressive strength greater than 3500 psi.

Gypsum based cement typically takes 2 to 4 hours to harden and 3-5 days to sufficiently dry. Higher alumina cements may sufficiently harden and dry in about four hours. Then the base plate 4 of the perimeter of the walls 2 may be lined with a perimeter isolation strip 10, for example, LEVELROCK Brand perimeter isolation strip. Then a layer of sound reduction mat 12, for example ¼ inch (0.6 cm) thick LEVELROCK Brand SRM-25 sound reduction mat, is placed over the first layer of cementitious material 46 but separated from the wall base plate 4 by the perimeter isolation strip 10.

A second upper surface layer of cementitious material 50, for example a layer of LEVELROCK Brand floor underlayment, is poured over the layer of sound reduction mat 12. The upper cementitious surface layer 50 may be of the same or similar material as used for the lower cementitious leveling layer 46 or it may be different. The upper surface layer 50 provides a sturdy level surface.

The upper surface layer of floor underlayment 50 typically has a thickness "E" of about ¼ to three inches, or ½ to 3 inches, preferably ½ to 1-½ in. and most preferably about ¾ to 1 inches (1.9 to 2.5 cm), typically about 1 inch (2.5 cm). Then a layer of flexible acoustic caulk 16 is placed on the perimeter of the upper surface of the second layer of cementitious material 50 and the wall studs 2 are covered with a layer of wallboard 18, for example ½ inch or ⅝ inch SHEETROCK Brand gypsum panels. The overall thickness "C" of the floor typically ranges from about 1 to 2 inches (2.5 to 5 cm).

Figure 5:
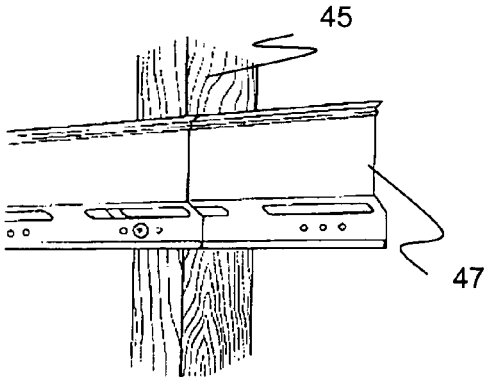
Fig. 5 (Prior art)
FIG. 5 shows a conventional DIETRICH RC DELUXE channel attached to a wooden stud.

An optional ceiling 48 may be attached to the joists 44 with sound insulators 49 which provide acoustical insulating properties. This ceiling is required for high acoustical performance. Typical sound insulators include channels, for example DIETRICH RC DELUXE resilient channels, or clips, such as RSIC-1 resilient sound insulation clips, employed with DIETRICH RC DELUXE channels or other hat channels. FIG. 5 shows a conventional DIETRICH RC DELUXE resilient channel 47 attached to a wooden stud 45.

Optionally, further improved acoustic performance may be obtained by including mineral wool or glassfiber insulation 43 between the joists 44 (one joist shown) in the ceiling. The location of the insulation 43 may be governed by fire performance requirements and the ability of the ceiling to provide fire protection.

As explained in more detail below, in contrast to conventional systems, where a 2-4 inch thick layer of concrete typically is poured onto steel decking, the present embodiment employs an underlayment of acoustical insulation embedded in thinner layers of poured cementitious material. This reduces overall flooring weight and achieves good sound insulation. The new design may use a steel deck which is heavier gage than the normal steel used with the conventional thick layer of lightweight concrete; however, this is dependent on the particular design. Unlike traditional design of composite steel deck systems, typically substantially all design loads are taken through the steel deck. The corrugated steel decking is typically nominal 9/16 inches deep and 22 gage. The corrugated steel deck provides at least 50 percent, or preferably greater than 70 percent, and most preferably greater than 90 percent of the ultimate static and impact load carrying capacity of the floor system with a floor deflection of at most 1/360 of the floor span.

The first and second layers of cementitious material, for example LEVELROCK® Brand Floor Underlayment, are used as a floor fill to meet service requirements The metal deck is designed for substantially all structural loads (gravity and lateral loads). Thus, the floor system is not designed as a conventional composite action floor system. The cementitious material is not used to transfer significant diaphragm shear forces or gravity forces for the main structural system. The first and second cementitious layers distribute load from items within the room to the structural system and acts as a surface or substrate for the installation of finished floor goods.

Figure 6:
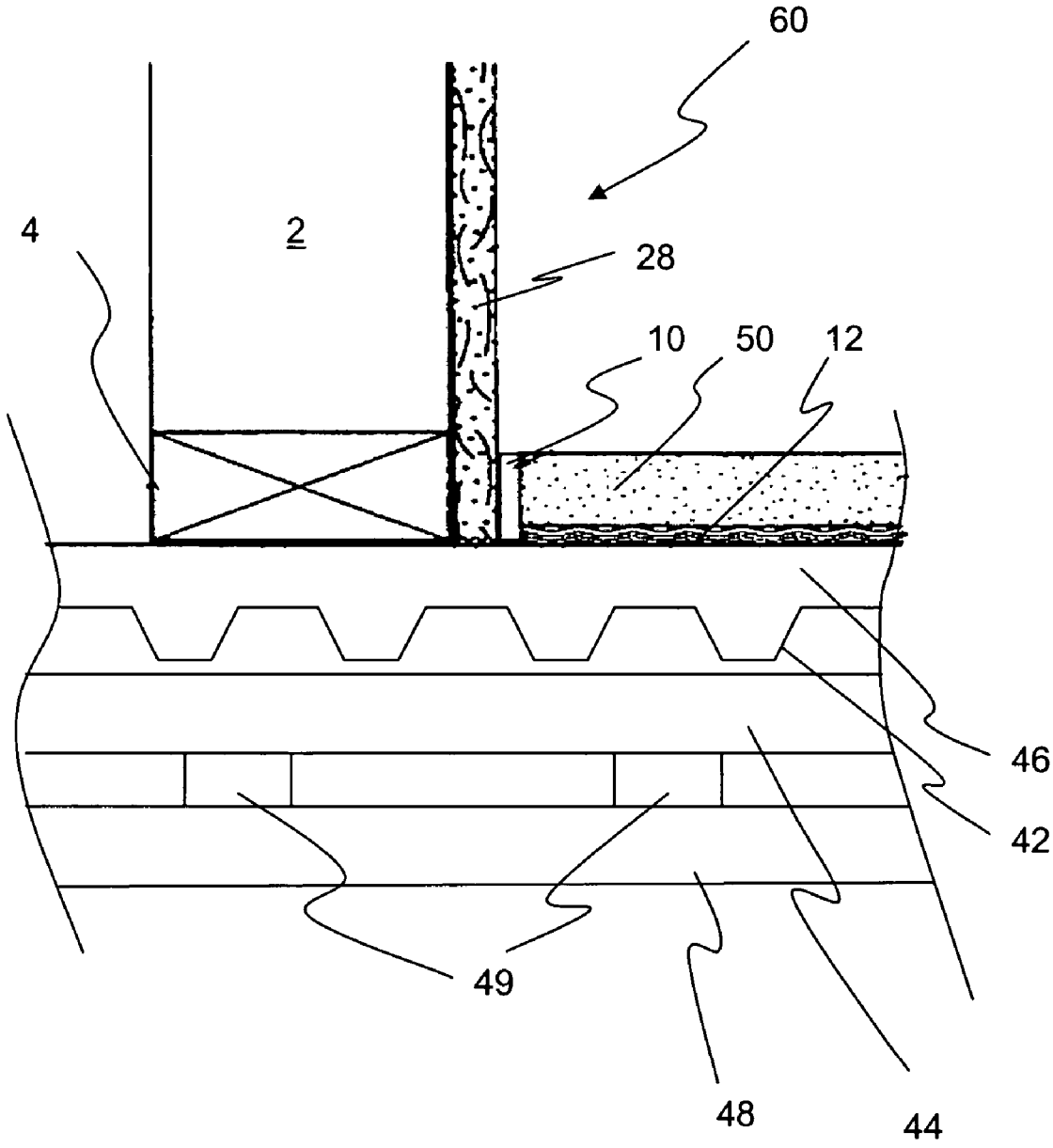
FIG. 6 shows a second embodiment of a floor of the present invention.

FIG. 6 shows a second embodiment of a flooring system 60 of the present invention. This embodiment 60 includes a corrugated steel deck 42 applied over steel joists or girders 44 (one shown). The corrugated steel deck 42 rests on the steel joists or girders 44 but FIG. 6 shows the corrugated steel deck 42 slightly spaced from the steel joists or girders 44 to make it easier to see the corrugated steel deck 42. A first lower leveling layer of cementitious material 46, for example LEVELROCK Brand Floor underlayment, is poured over the upper surface of the corrugated steel deck 42. This first lower leveling layer of cementitious material 46 typically has a thickness of about 0 to 1.5 inches (0 to 3.8 cm), preferably 0 to 1/8 inches (0 to 0.3 cm), typically about 0 inch (0 cm) above the flute of the corrugated steel deck 42.

After the first layer of cementitious material 46 is allowed to sufficiently harden, a wall having vertical studs 2 attached to a horizontal base plate 4 is placed on the first layer of cementitious material 46 and the wall studs 2 are covered with a layer of wallboard 28, for example 1/2 inch or 5/8 inch (1.3-1.6 cm) SHEETROCK Brand gypsum panels. Then a lower perimeter of the wallboard 28 is lined with a perimeter isolation strip 10, for example, LEVELROCK Brand perimeter isolation strip. A layer of sound reduction mat 12, for example 1/4 (0.6 cm) inch thick LEVELROCK Brand SRM-25 sound reduction mat, is placed over the first layer 46 but separated from the walls 28 by the perimeter isolation strip 10. An upper surface layer of floor underlayment 50, for example a 1 inch (2.5 cm) thick layer of LEVELROCK Brand floor underlayment, is poured over the layer of sound reduction mat 12. The upper surface layer of floor underlayment 50 typically has a thickness "E" (see FIG. 4) of about 1/4 to 3 inches, about 1/2 to 1.5 inches (1.3 to 3.8 cm), preferably about 3/4 to 1 inches (1.9 to 2.5 cm), typically about 1 inch (2.5 cm).

Figure 7:
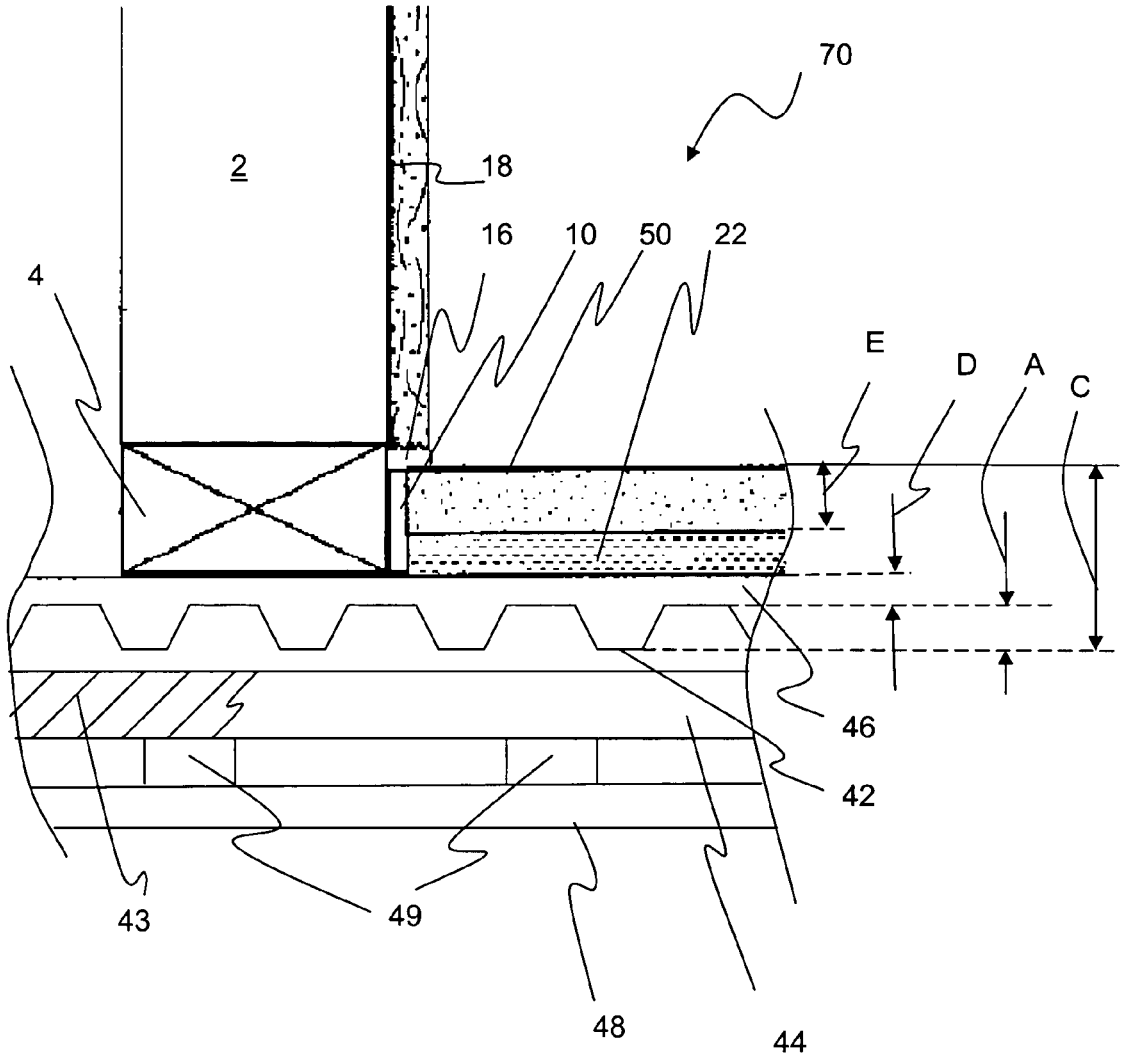
FIG. 7 shows a third embodiment of the present invention employing a first layer of underlayment poured over the upper surface of a corrugated steel deck, a layer of sound reduction board placed over the first layer of underlayment, and a second layer of underlayment poured over the upper surface of the layer of sound reduction board.

FIG. 7 shows a third embodiment of a flooring system 70 of the present invention. The corrugated steel deck 42 rests on the steel joists or girders but is shown slightly spaced from the corrugated steel deck 42 in FIG. 7 to make it easier to see the corrugated steel deck 42. This is substantially the same as that of FIG. 4 except the sound reduction mat 12 is replaced by a sound reduction board 22, for example a 3/8 inch thick layer of LEVELROCK Brand SRB sound reduction board. A layer of floor underlayment 50, for example a 3/4 inch minimum thick layer of LEVELROCK Brand floor underlayment, is poured over the layer of sound reduction board 22. This first lower leveling layer of cementitious material 46 typically has a thickness "D" of about 0 to 1.5 inches (0 to 3.8 cm), preferably 0 to 1/8 inches (0 to 0.3 cm), typically about 0 inch (0 cm) above the flute of the corrugated steel deck 42.

The upper surface layer of floor underlayment 50 typically has a thickness "E" of about 1/4 to 3 inches about 1/2 to 1.5 inches (1.3 to 3.8 cm), preferably about 3/4 to 1 inches (1.9 to 2.5 cm), typically about 1 inch (2.5 cm).

Figure 8:
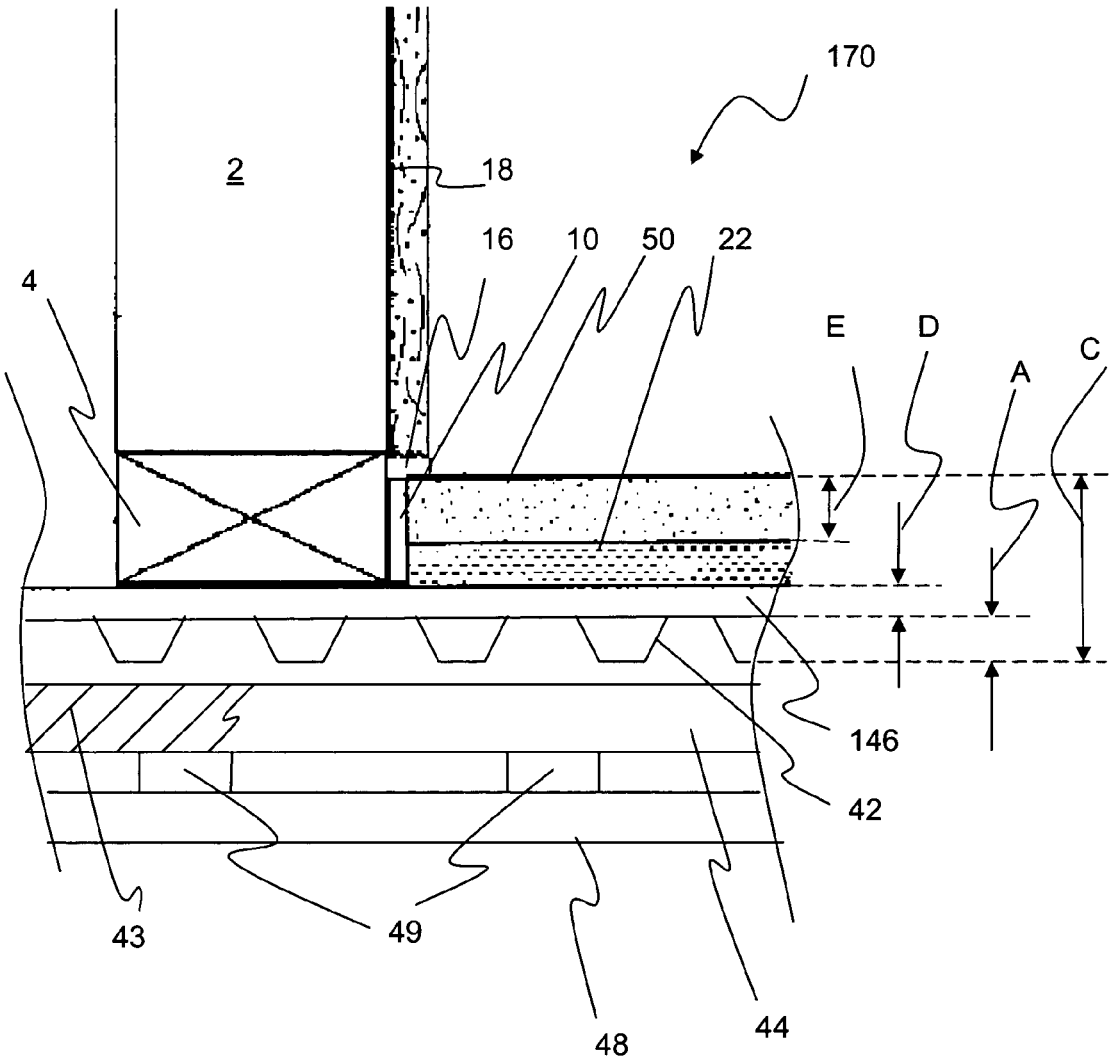
FIG. 8 shows a fourth embodiment of a floor system of the present invention.

A fourth alternate embodiment shown in FIG. 8 relates to a floor system comprising (from the bottom): a corrugated steel deck; a leveling board applied over the corrugated steel deck; a sound insulation mat or board applied over the leveling board; a layer of cementitious material applied over the sound insulation mat or board; wherein the floor system has an IIC rating of at least 25, preferably at least 30, even in the absence of a ceiling.

FIG. 8 shows an example of the fourth embodiment of a floor 170 of the present invention. This embodiment includes a corrugated steel deck 42 applied over steel joists or girders 44 (one shown). The corrugated steel deck 42 rests on the steel joists or girders 44 but is shown slightly spaced in FIG. 8 from the steel joists or girders 44 to make it easier to see the corrugated steel deck 42. A typical embodiment of steel decking has a deck flute "A" of about 9/16 inch (FIG. 8). A leveling board 146, for example FIBEROCK BRAND Gypsum Fiber Panel, is placed over the upper surface of the corrugated steel deck 42. This leveling board 146 typically has a thickness "D" of about 0.015 to 1.5 inches (0.04 to 3.8 cm), preferably about 0.015 to 0.5 inches (0.04 to 0.12 cm), most preferably 0.015 to 3/8 inches (0.04 to 0.95 cm), for example about 3/8 inch (0.95 cm).

The leveling board 146 may be attached to the steel deck 42 using mechanical or chemical fasteners to enable a firm surface for tradespersons to walk on it and improve surface performance. The base plate 4 and studs 2 are located to define the floor perimeter. Then the base plate 4 of the perimeter of the walls 2 may be lined with a perimeter isolation strip 10, for example, LEVELROCK Brand perimeter isolation strip. Then a layer of sound reduction board 22, for example a 3/8 inch thick layer of LEVELROCK Brand SRB sound reduction board, is placed over the leveling board 146 but separated from the wall base plate 4 by the perimeter isolation strip 10. If desired, the board 22 may be replaced by a sound reduction mat, for example 1/4 inch (0.6 cm) thick LEVELROCK Brand SRM-25 sound reduction mat.

An upper surface layer of cementitious material 50, for example a layer of LEVELROCK Brand floor underlayment, is poured over the layer of sound reduction board 22. The upper surface layer 50 provides a sturdy level surface.

The upper surface layer of floor underlayment 50 typically has a thickness "E" of about 1/4 to 3 inches, preferably 1/2 to 1-1/2 in. and most preferably about 3/4 to 1 inches (1.9 to 2.5 cm), typically about 1 inch (2.5 cm). Then a layer of flexible acoustic caulk 16 is placed on the perimeter of the upper surface of the second layer of cementitious material 50 and the wall studs 2 are covered with a layer of wallboard 18, for example 1/2 inch or 5/8 inch SHEETROCK Brand gypsum panels. The overall thickness "C" of the floor typically ranges from about 1 to 2 inches (2.5 to 5 cm).

An optional ceiling 48 may be attached to the joists 44 with sound insulators 49 which provide acoustical insulating properties. This ceiling is employed for high acoustical performance. Typical sound insulators include channels, for example DIETRICH RC DELUXE resilient channels, or clips, such as RSIC-1 resilient sound insulation clips, employed with DIETRICH RC DELUXE channels or other hat channels.

Optionally, further improved acoustic performance may be obtained by including mineral wool or glassfiber insulation 43 between the joists 44 (one joist shown) in the ceiling. The location of the insulation may be governed by fire performance requirements and the ability of the ceiling to provide fire protection.

The lower leveling board and cementitious material, for example FIBEROCK Brand Floor Underlayment, are used as a floor fill. The metal deck is designed for at least a majority of the structural loads (gravity and lateral loads). Thus, the floor system is not designed as a conventional composite action floor system. The leveling layer is not used to transfer significant diaphragm shear forces or gravity forces for the main structural system. The floor distributes loads from items within the room to the structural system and acts as a surface for the installation of finished floor goods.

The invention further relates to a method of construction of a floor system of the fourth embodiment comprising applying a first leveling board; applying a sound insulation mat or board over the leveling board; applying a layer of cementitious material, e.g., cement or concrete over the sound insulation mat or board, wherein the floor system has an IIC rating of at least 25, preferably at least 30, even in the absence of a ceiling.

The layers of board, for example LUAN, plywood, FIBEROCK Brand Gypsum Fiber Board, GP Dens-Deck, USG Structural Cement Panels, VIROC Brand high density boards or steel sheet are used as a leveling layer. The metal deck is designed for at least the majority of structural loads (gravity & lateral loads). Thus, the floor system is not designed as a conventional composite action floor system, in that the boards are not used to transfer significant diaphragm shear forces or gravity forces for the main structural system. The floor distributes loads from items within the room to the structural system and acts as a surface for the installation of finished floor goods.

The leveling board provides a level upper surface to which the acoustical mat will be applied. The first board layer may be made of any flat sheet material that does not contain materials harmful to steel decking and has sufficient resilience for application of the upper cementitious layer. Harmful materials would be those that may corrode or deteriorate the underlying steel decking. Alternatively, the deck may be coated or otherwise protected against deterioration using organic, metallic or inorganic coatings to prevent contact between the two materials. Suitable leveling boards include any made from wood, cement, gypsum, metal or combinations. The leveling board has a thickness of about 0.015 to 1.5 inches (0.04 to 3.8 cm), preferably about 0.015 to 0.5 inches (0.04 to 0.12 cm), most preferably 0.015 to ⅜ inches (0.04 to 0.95 cm), for example about ⅜ inch (0.95 cm).

This board may be reinforced using continuous strands, cut or chopper fibers that may be made of organic, inorganic or metallic materials including alkali resistant or coated glass, steel, carbon fiber, KEVLAR strand.

The embedded acoustical material may include any mat or board that provides decoupling of acoustic noise. The mat or board should increase the IIC of the assembly by >4, preferably >7 and most preferably >10 IIC points in a given assembly. If this mat has sufficient resiliency, the lower cementitious layer or leveling board may be eliminated from the invention.

Figure 9:
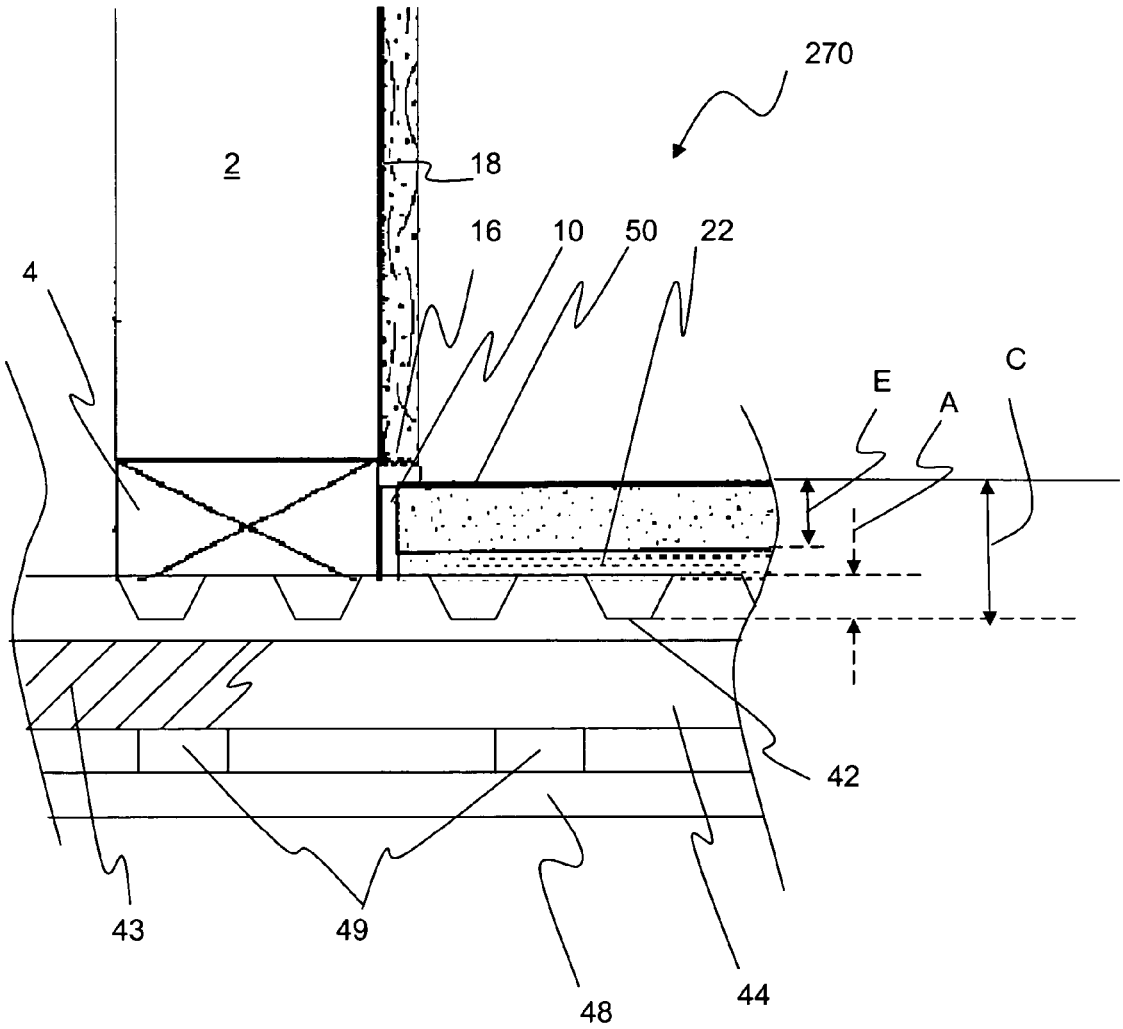
FIG. 9 shows a fifth embodiment of a floor system of the present invention employing a stiff acoustical board placed over the upper surface of a corrugated steel deck, and a second layer of underlayment poured over the upper surface of the layer of the sound reduction mat.

A fifth embodiment shown in FIG. 9 relates to a floor system 270 which is substantially the same as the fourth embodiment but lacks a lower leveling layer. Thus, the fifth embodiment comprises (from the bottom): a corrugated steel deck; a sound insulation board applied over the deck that has sufficient resilience to span between flutes of the corrugated deck; a layer of cementitious material applied over the sound insulation board; wherein the floor system has an IIC rating of at least 25, preferably at least 30, even in the absence of a ceiling. The corrugated steel deck 42 rests on the steel joists or girders but is shown slightly spaced in FIG. 9 to make it easier to see the corrugated steel deck 42.

The present invention provides flooring having lower total system weight than conventional flooring made with lightweight cement poured into a corrugated steel pan. For comparison, the weight of the deck in conventional lightweight concrete would use concrete with a density of about 120 lbs./cu. ft., but a thickness of at least 3.5 inches (8.9 cm) above the flute of the deck. This results in a weight of about 35 lbs./sq. ft. In contrast, an embodiment of the present invention having a corrugated steel deck with 9/16 inch (1.4 cm) corrugation filmed with LR-CSD (LEVELROCK BRAND CSD) underlayment) covering the steel flush to the height of the flute, LEVELROCK BRAND FLOOR UNDERLAYMENT SRM-25 acoustical mat and 1 inch (2.54 cm) of LEVELROCK BRAND UNDERLAYMENT over the mat having a dry density of about 115 lb./cu. ft. would have a weight of 10 lbs./sq. ft.

I. Steel Joists

The steel joists which support the steel decking are any which can support the system. Typical steel joists may include those outlined by the SSMA (Steel Stud Manufacturer's Association) for use in corrugated steel deck systems, or proprietary systems, such as those sold by Dietrich as TRADE READY Brand joists. Joist spacing of 24 inches (61 cm) is common. However, spans between joists may be greater or less than this. C-joists and open web joists are typical.

II. Steel Decking

The steel decking 42 is typically designed using steel properties provided by the Steel Deck Institute (SDI) to withstand the design loads for this floor without requiring additional strength from the cementitious layers. As a result, the steel decks used for a given design load are typically thicker than would conventionally be used for that design load in a typical cement and corrugated steel deck system. For example, for a design load of 40 psf the corrugated steel decking on lightweight steel C-joists spaced at 24 in. centers is typically 9/16 inches deep and 22-24 gage.

The present floor system may have a lower unit weight than a floor system of open web bar joists, metal deck and poured in place concrete or precast plank with a topping slab on load bearing walls. Unit weight is defined as the unit weight of a floor system in lbs/sq. ft. to satisfy a design deflection parameter value and at least one corresponding strength requirement for a particular span and loading condition. A typical design deflection parameter is a maximum deflection of at most L/360, where L is the length of the span of the floor. The loading condition is typically vertical loads of a predetermined amount. Strength in this definition is flexural strength and/or shear strength for vertical and/or horizontal loads on the floor. Vertical loads include live and/or dead loads. Horizontal (transverse) loads include loads applied by wind and/or seismic action.

For instance, a comparison can be made of systems including a 20 foot span designed to withstand live loads and dead loads of 40 pounds per square foot with a floor deflection in inches calculated as less than ((20 feet ×12 inches/foot)/360) inches, i.e., 0.667 inches. An embodiment of the present system having floor diaphragm comprising a horizontal diaphragm, having from bottom to top a corrugated metal deck, a first layer of cementitious material having a thickness of 0-⅛ in. inch above the flute of the corrugated metal deck, a layer sound insulation mat, and a second layer of cementitious material having a thickness of one inch, installed on a 20 foot span of open bar joists, should have having a lower unit weight than a 20 foot span floor system of open bar joists, installed on a floor diaphragm of corrugated metal deck and a four inch thick concrete slab.

III. Lower Cementitious Leveling Layer

Cementitious material is generally a pourable material, as distinguished from a precast board.

The lower cementitious leveling layer fills the corrugations of the steel decking. The lower cementitious leveling layer provides a level surface for the acoustical mat and does not contain materials that are deleterious to steel decking. The lower cementitious layer typically has a compressive strength of >750 psi, preferably >1200 psi, more preferably >2000 psi, most preferably >3500 psi.

Typical materials for the lower cementitious leveling layer are inorganic binder, e.g., calcium sulfate alpha hemihydrate, hydraulic cement, Portland cement, high alumina, pozzolanic materials, water, and optional additives. A typical pourable cementitious underlayment system of the invention comprises hydraulic cement such as Portland cement, high alumina cement, pozzolan-blended Portland cement, or mixtures thereof. A typical composition has 0 to 50 weight % Portland cement, 50 to 100 weight % gypsum based cement; 0.5 to 2.5 parts sand per 1 part by weight gypsum; and 10 to 40 parts water added per 100 parts by weight solids. An example of such poured cement has 25 weight % Portland cement, 75 weight % gypsum based cement, 2 parts by weight sand per 1 part total cement and 20 parts water added per 100 parts by weight solids. If desired a primer, for example LEVELROCK Brand CSD primer, may be placed on the steel deck prior to applying the first cementitious layer.

Another embodiment of the suitable materials for the lower cementitious leveling layer of the present invention comprises a blend containing calcium sulfate alpha hemihydrate, hydraulic cement, pozzolan, and lime.

Examples of suitable materials for the lower cementitious leveling layer include:

I. Gypsum cements based (LEVELROCK Brand 2500, CSD, 3500, RH, HACKER, MAXXON, and combinations such as 2500/PRO FLOW).

II. Portland cement based (LEVELROCK Brand SLC-200), lightweight or normal weight concrete.

III. High alumina cement based (ARDEX K-15, LEVELROCK BRAND SLC-300, SLC-400, FINJA 220, 240, 540).

IV. Other cement based (MAXXON LEVEL RIGHT).

Calcium Sulfate Hemihydrate (Gypsum Cements)

Calcium sulfate hemihydrate, which may be used in an upper surface layer of the invention, is made from gypsum ore, a naturally occurring mineral, (calcium sulfate dihydrate $CaSO_4.2H_2O$). Unless otherwise indicated, "gypsum" will refer to the dihydrate form of calcium sulfate. After being mined, the raw gypsum is thermally processed to form a settable calcium sulfate, which may be anhydrous, but more typically is the hemihydrate, $CaSO_4.½ H_2O$. For the familiar end uses, the settable calcium sulfate reacts with water to solidify by forming the dihydrate (gypsum). The hemihydrate has two recognized morphologies, termed alpha hemihydrate and beta hemihydrate. These are selected for various applications based on their physical properties and cost. Both forms react with water to form the dihydrate of calcium sulfate. Upon hydration, alpha hemihydrate is characterized by giving rise to rectangular-sided crystals of gypsum, while beta hemihydrate is characterized by hydrating to produce needle-shaped crystals of gypsum, typically with large aspect ratio. In the present invention either or both of the alpha or beta forms may be used depending on the mechanical performance desired. The beta hemihydrate forms less dense microstructures and is preferred for low density products. The alpha hemihydrate forms more dense microstructures having higher strength and density than those formed by the beta hemihydrate. Thus, the alpha hemihydrate could be substituted for beta hemihydrate to increase strength and density or they could be combined to adjust the properties.

Hydraulic Cement

ASTM defines "hydraulic cement" as follows: a cement that sets and hardens by chemical interaction with water and is capable of doing so under water. There are several types of hydraulic cements that are used in the construction and building industries. Examples of hydraulic cements include Portland cement, slag cements such as blast-furnace slag cement and super-sulfated cements, calcium sulfoaluminate cement, high-alumina cement, expansive cements, white cement, and rapid setting and hardening cements. While calcium sulfate hemihydrate does set and harden by chemical interaction with water, it is not included within the broad definition of hydraulic cements in the context of this invention. All of the aforementioned hydraulic cements can be used to make the cementitious components of the invention.

The most popular and widely used family of closely related hydraulic cements is known as Portland cement. ASTM defines "Portland cement" as a hydraulic cement produced by pulverizing clinker consisting essentially of hydraulic calcium silicates, usually containing one or more of the forms of calcium sulfate as an interground addition. To manufacture Portland cement, an intimate mixture of limestone, argallicious rocks and clay is ignited in a kiln to produce the clinker, which is then further processed. As a result, the following four main phases of Portland cement are produced: tricalcium silicate ($3CaO.SiO_2$, also referred to as $C_3S$), dicalcium silicate ($2CaO.SiO_2$, called $C_2S$), tricalcium aluminate ($3CaO.Al_2O_3$ or $C_3A$), and tetracalcium aluminoferrite ($4CaO.Al_2O_3.Fe_2O_3$ or $C_4AF$). Other compounds present in minor amounts in Portland cement include calcium sulfate and other double salts of alkaline sulfates, calcium oxide, and magnesium oxide. The other recognized classes of hydraulic cements including slag cements such as blast-furnace slag cement and super-sulfated cements, calcium sulfoaluminate cement, high-alumina cement, expansive cements, white cement, rapidly setting and hardening cements such as regulated set cement and VHE cement, and the other Portland cement types can also be successfully in the present invention. The slag cements and the calcium sulfoaluminate cement have low alkalinity and are also suitable for the present invention.

IV. Leveling Board

The leveling board spans the corrugations of the steel decking and provides a level surface for the acoustical mat and does not contain materials that are deleterious to steel decking.

Typical materials for the board of the lower leveling layer are wood, gypsum or Portland cement based.

Examples of suitable materials for the lower leveling layer include:

FIBEROCK Brand Floor Underlayment
GP Brand Dens-Deck
Luan underlayment
Plywood decking
USG structural cement panels
DUROCK Brand Cement Board
James Hardie HARDIBACKER Cement Board.
Steel sheet Typical leveling board applied over the corrugated steel deck has a thickness of about 0.15 to 1.5 inches. Typical steel sheet has a thickness of ⅛-⅜ inch.

Sound boards are envisioned that may have sufficient strength to span between flutes of the steel decking. In these cases, use of the lower cementitious layer of leveling layer is not required.

V. Embedded Acoustical Material

The embedded acoustical material may include any mat or board that provides decoupling of acoustic noise. The mats are relatively bendable as compared to the relatively stiff boards. For example, at least some mats can be delivered to the job site as rolls, whereas boards are typically delivered as sheets.

Such mats or boards to improve IIC performance include but are not limited to:

- LEVELROCK CSD mats, SRM-25 sound reduction mats available from USG Corp., Chicago, Ill.
- LEVELROCK SRB brand sound reduction boards available from USG Corp., Chicago, Ill.
- ENKASONIC 9110 available from Colbond Inc., Enka, N.C.
- ACOUSTIMAT II AND III available from MAXXON Corp., Hamel, Minn. Cork The mat or board should increase the IIC of the assembly by >4, preferably >7 and most preferably >10 IIC points in a given assembly.

LEVELROCK Brand SRM-25™ is a ¼" sound reduction mat made of a polyethylene core and polypropylene fabric. It is used to meet the minimum ICC code criteria of a 50 IIC and 50 STC. SRM-25™ sound reduction mat can improve IIC values by as much as 13 points, depending on the system tested. SRM-25™ can exceed 60 IIC and 60 STC points based tested assemblies. Typically this sound reduction mat is employed with accessories such as SRM LEVELROCK Brand Seam Tape and LEVELROCK brand perimeter isolation strip polyethylene foam available from USG Corp.

LEVELROCK SRB brand sound reduction boards are made of man-made vitreous fiber, such as slag wool fiber, and minerals.

ENKASONIC 9110 sound reduction mat has 0.4 inch (10 mm) thick extruded nylon filaments forming a three-dimensional core that has a nonwoven fabric heat bonded to its upper surface.

ACOUSTIMAT II and ACOUSTIMAT IIII sound reduction mats consist of a nylon core of fused, entangled filaments attached to a non-woven fabric. The ACOUSTIMAT IIII sound reduction mat is three times as thick as the ACOUSTIMAT II sound reduction mat.

U.S. Pat. No. 5,867,957 to Holtrop (Solutia, Inc.), incorporated herein by reference, also discloses a sound insulation pad, having a three dimensional shaped surface, suitable for use in the present invention.

VI. Upper Cementitious Layer

The upper cementitious surface layer provides a layer over the acoustical mat to provide an upper surface suitable for placing flooring, e.g., carpeting, vinyl tiles, ceramic tiles or linoleum flooring. The upper cementitious surface layer may be made of any of the materials described above for the lower cementitious leveling layer. The upper cementitious layer typically has a compressive strength of >750 psi, preferably >1200 psi, more preferably >2000 psi, most preferably >3500 psi.

VII. Optional Components

Optionally, improved acoustic performance may be obtained by including mineral wool or glassfiber insulation between the joists.

A ceiling may also be attached to improve acoustical performance. Ceilings constructed from gypsum wallboard or ceiling tile are envisioned. These ceilings may be attached using acoustic isolators, such as DIETRICH RC DELUXE resilient channels attached to joists directly or with RSIC-1 clips. Alternatively, these ceilings may be drywall suspension systems hung from the joists.

Preferred Properties of a Floor of the Invention

The floor system is designed to limit live load and superimposed dead load floor deflections to at most 1/360 of the span (L/1/360) for predetermined gravity loads. The cementitious material, for example, LEVELROCK® Brand Floor Underlayment, is used as a non-structural floor fill. The metal deck is designed for substantially all structural loads (gravity & lateral loads). The sheet of corrugated steel is designed to provide 100% of the ultimate load carrying capacity under static loading and under impact loading with a floor deflection of at most 1/360 of the floor span.

EXAMPLE 1

Tests were conducted according to ASTM C627-93 (1999) to determine the serviceability of the proposed invention. In these tests, floors were constructed using corrugated steel deck placed over wood joists. In the first tests two samples were conducted using no sound mat with the flooring material (LEVELROCK BRAND FLOOR UNDERLAYMENT CSD) placed either ¾ or 1 in. above the flutes of the corrugated steel deck. A second set of samples were constructed including sound mats. In these samples LEVELROCK BRAND CSD was placed in the flutes. The sound mat (SRM-25 Brand sound reduction mat) was then placed on the flutes and a layer of LEVELROCK BRAND FLOOR UNDERLAYMENT 3500 was placed over the mat at either ¾ or 1 in. thickness. Prior to testing all four systems were tiled using 2×2 in. ceramic tiles.

All 4 systems failed at cycle 6, demonstrating that the performance of the systems with and without the sound mats were similar.

Similar tests were also conducted to those described above, except that LEVELROCK BRAND FLOOR UNDERLAYMENT 2500 was placed on top of the sound mat. In these tests the flooring at ¾ in. failed after cycle 4; while the system with 1 in. of underlayment failed at Cycle 7.

Based upon these tests it was found that the durability of the system under rolling wheel loads would be dependent on the thickness and type of the underlayment.

Results are presented below in TABLE A.

TABLE A

| | LR 3500/CSD/SOUND MAT | | | | LR 2500/CSD/SOUND MAT | |
|---|---|---|---|---|---|---|
| | ID | | | | | |
| | SYSTEM-1 | SYSTEM-2 | SYSTEM-3 | SYSTEM-4 | SYSTEM-1 | SYSTEM-2 |
| FINISH | 2 × 2 TILE | 2 × 2 TILE | 2 × 2 TILE | 2 × 2 TILE | 2 × 2 TILE | 2 × 2 TILE |
| LEVELROCK | ¾-IN | 1-IN | ¾-IN | 1-IN | ¾-IN | 1-IN |
| BRAND | ABOVE | ABOVE | ABOVE MAT | ABOVE MAT | ABOVE MAT | ABOVE MAT |

TABLE A-continued

| | LR 3500/CSD/SOUND MAT | | | | LR 2500/CSD/SOUND MAT | |
|---|---|---|---|---|---|---|
| | ID | | | | | |
| | SYSTEM-1 | SYSTEM-2 | SYSTEM-3 | SYSTEM-4 | SYSTEM-1 | SYSTEM-2 |
| UNDERLAYMENT | FLUTES LEVELROCK CSD | FLUTES LEVELROCK CSD | LEVELROCK CSD/3500 | LEVELROCK CSD/3500 Flutes filled with CSD, LR3500 on top of mat | LEVELROCK CSD/2500 | LEVELROCK CSD/2500 |
| SOUND MAT | NO MAT | NO MAT | SRM-25 SOUND MAT | SRM-25 SOUND MAT | SRM-25 SOUND MAT | SRM-25 SOUND MAT |
| DECK | 9/16-IN/ 26 GA CSD | 9/16-IN/ 26 GA CSD | 9/16-IN/ 26 GA CSD | 9/16-IN/26 GA CSD | 9/16-IN/ 26 GA CSD | 9/16-IN/ 26 GA CSD |
| FRAMING | WOOD JOISTS 2 × 6@24-IN OC | WOOD JOISTS 2 × 6@24-IN OC | WOOD JOISTS 2 × 6@24-IN OC | WOOD JOISTS 2 × 6@24-IN OC | WOOD JOISTS 2 × 6@24-IN OC | WOOD JOISTS 2 × 6@24-IN OC |
| Date tested | Jul. 6, 2004 | Jul. 8, 2004 | Jul. 7, 2004 | Jul. 9, 2004 | Nov. 17, 2004 | Nov. 18, 2004 |
| RESULTS/ COMMENTS | TILE FAILURE ON CYCLE 6 | TILE FAILURE ON CYCLE 6 | TILE FAILURE ON CYCLE 6 | TILE FAILURE ON CYCLE 6 | FAILURE ON CYCLE 4 | FAILURE ON CYCLE 7 |

EXAMPLE 2

Tests were conducted in a standard acoustic chamber according to ASTM E90 and ASTM E492 to determine the STC and IIC performance of various floors.

Tests were conducted on two invention floors that differed by the type of ceiling assembly. To determine the improvement of the invention over current practice in which no acoustical mat is embedded, floors without acoustical mats were also tested.

In general, floor/ceiling assemblies for the invention were constructed using lightweight steel C-joists, corrugated metal pans, and LEVELROCK Brand FLOOR UNDERLAYMENT CSD. Tests for the invention included 1 in. of LEVELROCK BRAND CSD placed over SRM-25 sound mat. This was placed over a layer of LEVELROCK BRAND CSD that filled the flutes of the 22 gage, 9/16 in. corrugated metal deck. Two ceiling assemblies were evaluated. The first used USG DWSS Grid system suspended with Prototype acoustical clips spaced 48" o.c. The second used the same ceiling system, without the prototype acoustical clip attached using standard published methods for attachment of DWSS grid.

Companion floors were also constructed that did not use the acoustical mat embedded in the floor. Floor/ceiling assemblies were constructed using lightweight steel C-joists, corrugated metal pans, and LEVELROCK Brand FLOOR UNDERLAYMENT CSD. Tests included 1 in. of LEVELROCK BRAND CSD over the top of the flutes of the 22 gage, 9/16 in. corrugated metal deck. Again, two ceiling assemblies were evaluated. The first used USG DWSS Brand Grid system suspended with Prototype acoustical clips spaced 48" o.c. The second used the same ceiling system, without the prototype acoustical clip.

For all 4 systems, results were obtained using ASTM E90 "Standard Test Method for Laboratory Measurement of Airborne Sound Transmission Loss of Building Partitions and Elements" and ASTM E492-04 "Standard Test Method for Laboratory Measurement of Impact Sound Transmission Through Floor-Ceiling Assemblies Using the Tapping Machine" are shown below.

INVENTION A

1" LEVELROCK CSD Brand underlayment

SRM-25 Brand sound reduction mat 22 gage metal deck filled with LEVELROCK CSD Brand underlayment to top of flutes.

14" 14 gage Steel C-Joist (Dietrich) 24" on center (o.c.) spanning long dimension of room.

3-½" R-11 glassfiber in cavities.

USG DWSS Brand Grid system suspended with Prototype acoustical clips spaced 48" o.c.

Top bulb of grid ½" below joist

One layer ⅝" SHEETROCK FIRECODE "C" Brand gypsum board as ceiling material.

Results A a) No Finish STC=64; IIC=50 b) With PERGO Brand laminate flooring STC=63; IIC=57 c) Sheet Vinyl STC=n/r; IIC=53

Invention B

1" LEVELROCK Brand CSD floor underlayment (Actual pour for test 1")

SRM-25 Brand sound reduction mat 22 gage metal deck filled with LEVELROCK Brand CSD floor underlayment to top of flutes.

14" 14 gage Steel C-Joist (Dietrich) 24" o.c. spanning long dimension of room.

3-½" R-11 glassfiber in cavities.

USG DWSS Brand Grid system suspended from wire spaced 48" o.c. Top bulb of grid ½" below joist and one layer ⅝" SHEETROCK FIRECODE "C" Brand gypsum board.

Results B These Results with Direct Hanger Wire Suspension a) No Finish STC=65; IIC=50 b) With PERGO brand laminate flooring STC=63; IIC=59 c) Sheet Vinyl STC=64; IIC=55

Comparison Tests C and D:

1" LEVELROCK Brand CSD floor underlayment above filled flutes 22 gage metal deck filled with LEVELROCK Brand CSD floor underlayment to top of flutes.

14" 14 gage Steel C-Joist (Dietrich) 24" o.c. spanning long dimension of room.

3-½" R-11 glassfiber in cavities.

USG DWSS Brand Grid system suspended with Prototype acoustical clips spaced 48" o.c. Top bulb of grid ½" below joist.

One layer ⅝" SHEETROCK FIRECODE "C" Brand gypsum board.

Results C: with Prototype Clip a) No Finish STC=61 and IIC=37.

b) with PERGO Brand laminate flooring STC=61 IIC=58 c) Sheet Vinyl STC=n/r IIC=45

Results D: with Direct Hanger Wire Suspension a) No Finish STC=62 IIC=34 b) with PERGO Brand laminate flooring STC=62 IIC=58 c) SheetVinyl STC=61 IIC=42

These tests indicate an improvement of 13 IIC points and 3 STC points for adding the SRM-25 (¼" of LEVELROCK underlayment replaced by SRM-25).

The "No Finish" results indicate the improvement would be 16 points direct hung and 13 points prototype for IIC and 3 STC points in both cases. Note the more effective the finish floor the more it "mask" the improvement provided by the embedded SRM-25 or the ceiling configuration.

EXAMPLE 3

Small scale tests were conducted to determine the acoustic properties of flooring systems constructed using leveling boards placed over 9/16 in. corrugated steel decks. Four samples (4×4 ft) were constructed. These small sections of floors were then placed on an existing floor-ceiling assembly.

This assembly consisted of the following (top down):

2-¼"×2-¼" Mosaic Ceramic Tiles adhered to NobleSeal Brand CIS crack isolation sheet with a standard thin-set mortar and grouted. The Noble CIS was adhered to the ¾" LEVELROCK Brand floor underlayment with Noble 21 Brand adhesive. The LEVELROCK Brand floor underlayment was poured over a ⅜" thick sheet of USG SRB Brand sound reduction board, which was loose laid over nominal ¾" OSB panels. The OSB was screw attached to 9-½" Wood I-Joists that were spaced 24" o.c. Resilient channels (RC-1 Deluxe) were screw attached to the lower flange of the I-Joist at 16" o.c. and 3-½" R-11 glassfiber insulation was placed in the joist cavity near the cavities vertical mid-point and held in place with "lightening rod" clips. A double layer of ½" USG SHEETROCK FIRECODE "C" Brand gypsum panels was screw attached to the resilient channels with the face layer screws at 12" o.c. The board joints were sealed with duct tape and the upper and lower perimeter was sealed with a dense mastic compound.

Perpendicular lines drawn through the room center point and the four panels were placed in the NW, SW, SE and NE intersecting corners of the perpendicular lines as close to the center point as possible without touching and located so that a joist lay beneath the midline of each sample. Due to the size of the samples, a modified impact test was conducted, using only 2 tapping machine location one perpendicular and one parallel to and falling over the joist. Each sample was placed over a thin sheet of clear plastic to prevent damage to the existing floor during the pouring of the LEVELROCK Brand Floor Underlayment in the four panels.

A standard ISO Tapping Machine as described in ASTM E492 Test Method was used. The impact sound pressure levels were measured in the room below at four microphone locations for each tapping machine location. The values were averaged and rounded to the nearest whole number but not normalized. The un-normalized impact sound pressure level at the standard 100 to 3150 ⅓ Octave Bands were then classed using the ASTM E989 Classification procedures to obtain a non-standard Un-Normalized IIC (Impact Insulation Class) UNIIC)

The non-standard UNIIC of the base floor was calculated at 47.

1. CONTROL SAMPLE a. 9/16 in. corrugated steel deck b. LEVELROCK Brand Floor Underlayment poured 1 in. above flutes c. RESULTANT UIIC=59

2. EXAMPLE A CONTAINING FIBEROCK BRAND FLOOR UNDERLAYMENT AS SOUND REDUCTION MATERIAL d. 9/16 in. corrugated steel deck e. ⅜ in. thick FIBEROCK BRAND FLOOR UNDERLAYMENT f. 1 in. LEVELROCK Brand Floor Underlayment g. RESULTANT UIIC=62

3. EXAMPLE B CONTAINING FIBEROCK BRAND FLOOR UNDERLAYMENT AND LEVELROCK SOUND REDUCTION BOARD (SRB)

a. 9/16 in. corrugated steel deck h. ⅜ in. thick FIBEROCK BRAND FLOOR UNDERLAYMENT i. LEVELROCK BRAND SOUND REDUCTION BOARD j. 1 in. LEVELROCK Brand Floor Underlayment k. RESULTANT UIIC=65

4. EXAMPLE C CONTAINING FIBEROCK BRAND FLOOR UNDERLAYMENT AND LEVELROCK SOUND REDUCTION MAT (SRM-25)

a. 9/16 in. corrugated steel deck l. ⅜ in. thick FIBEROCK BRAND FLOOR UNDERLAYMENT m. LEVELROCK BRAND SOUND REDUCTION MAT (SRM-25)

n. 1 in. LEVELROCK Brand Floor Underlayment o. RESULTANT UIIC=66

It should be apparent that embodiments other than those expressly discussed above are encompassed by the present invention. Thus, the present invention is defined not by the above description but by the claims appended hereto.

What is claimed is:

1. A floor system for a building comprising:

a corrugated steel deck;

a first lower leveling layer of a member selected from the group consisting of cementitious material, leveling board and leveling layer sheet, applied over the corrugated steel deck;

a sound reduction layer comprising a member of the group consisting of a sound reduction mat and sound reduction board;

a second upper layer of cementitious material applied over the sound reduction layer and separated from the lower layer, the second layer having an upper and opposed lower surface;

wherein the sound reduction layer is embedded between the first lower leveling layer and the second upper layer is under and contacts the entire lower surface of the second upper layer to completely separate and prevent any contact between the first lower leveling layer and the second upper layer for decoupling acoustic sound transmission between the first lower leveling layer and the second upper layer, wherein the sound reduction mat comprises a member of the group consisting of a polyethylene core and nylon filaments forming a three dimensional core, and the sound reduction board comprises man-made vitreous fiber, wherein the first lower leveling layer extends about 0 inches to at most about 1.5 inches (3.8 cm) above a flute of the corrugated steel deck, and wherein sufficient amount of the sound reduction layer is provided to increase IIC rating of the system by <7 IIC points above that of the system in the absence of the sound reduction layer, wherein the second upper layer has a thickness of about 0.25 inches to 3 inches, and wherein the perimeters of the sound reduction layer, and second layer, are surrounded by perimeter isolation strips in order to separate the sound reduction layer and the second upper layer of cementitious material from a vertically extending wall to be installed on the first lower leveling layer.

2. The system of claim 1, wherein the floor system has an IIC rating of at least 25 and the corrugated steel deck provides at least 50 percent of ultimate load carrying capacity under static and impact loading of the floor system with a floor deflection of at most 1/360 of floor span.

3. The system of claim 1, wherein the floor system has an IIC rating of at least 30 and the corrugated steel deck provides at least 70 percent of ultimate load carrying capacity under static and impact loading of the floor system with a floor deflection of at most 1/360 of floor span.

4. The system of claim 1, wherein the floor system has an IIC rating of at least 30 and the corrugated steel deck provides at least 90 percent of ultimate load carrying capacity under static and impact loading of the floor system with a floor deflection of at most 1/360 of floor span.

5. The system of claim 1, wherein the first lower layer comprises cementitious material and has a compressive strength of >750 psi and a sound reduction layer thickness of 0.015 to 1.5 inches (0.04 to 3.8 cm).

6. The system of claim 1, wherein the first lower layer comprises cementitious material and has a compressive strength of >1200 psi, the sound reduction layer is the sound reduction mat, and the mat is selected from the group consisting of mat having a core of nylon filaments attached to a nonwoven fabric and mat made of the polyethylene core and polypropylene fabric.

7. The system of claim 1, wherein the first lower layer comprises cementitious material and has a compressive strength of >2000 psi, the sound reduction layer is the sound reduction board and the sound reduction board comprises slag wool fiber and minerals.

8. The system of claim 1, wherein the first lower layer comprises cementitious material and has a compressive strength of >3500 psi.

9. The system of claim 1, wherein the first lower layer extends about 0 to ½ inches (0 to 1.2 cm) above the flute of the corrugated steel deck.

10. The system of claim 1, wherein the first lower layer extends about 0 to ⅛ inches (0 to 0.3 cm) above the flute of the corrugated steel deck.

11. The system of claim 1, wherein the first lower layer extends about 0 inches above the flute of the corrugated steel deck.

12. The system of claim 1, wherein the first lower layer extends about 0 to ½ inches (0 to 1.2 cm) above the flute of the corrugated steel deck, wherein the first lower layer comprises cementitious material and has a compressive strength of >750 psi and a sound reduction layer thickness of 0.015 to 1.5 inches (0.04 to 3.8 cm), wherein the floor system has an IIC rating of at least 30 and the corrugated steel deck provides at least 90 percent of ultimate load carrying capacity under static and impact loading of the floor system with a floor deflection of at most 1/360 of floor span, wherein the deck is supported on metal joists, comprising a member of the group consisting of a ceiling attached to the joists with acoustic isolators and a suspended ceiling provided under the joists, wherein the cementitious materials are selected from the group consisting of gypsum cement, hydraulic cement, Portland cement, lightweight concrete and mixtures thereof; further comprising a horizontal wall base plate and vertical wall studs resting on the lower leveling layer and located to define a perimeter of the floor.

13. The system of claim 1, wherein the second upper layer has a thickness of about 0.5 to 1.5 inches thick.

14. The system of claim 1, wherein the second upper layer has a thickness about ¾ to 1 inch (1.9 to 2.5 cm).

15. The system of claim 1, wherein the deck is supported on metal joists.

16. The system of claim 15, comprising a member of the group consisting of a ceiling attached to the joists with acoustic isolators and a suspended ceiling provided under the joists.

17. The system of claim 15, further comprising a ceiling attached to the joists, wherein the floor system has an IIC rating of at least 40.

18. The system of claim 15, further comprising a ceiling attached to the joists, wherein the floor system has an IIC rating of at least greater than 50.

19. The system of claim 1, wherein the cementitious materials are selected from the group consisting of gypsum cement, hydraulic cement, Portland cement, lightweight concrete and mixtures thereof.

20. The system of claim 1, wherein the cementitious materials comprise 0 to 50 weight % Portland cement, 50 to 100 weight % gypsum based cement; 0.5 to 2.5 parts by weight sand per 1 part by weight gypsum; and 10 to 40 parts by weight water added per 100 parts by weight solids.

21. The system of claim 1, comprising the sound reduction mat.

22. A method of construction of a floor system in a building, comprising:

applying a first lower leveling layer of a member selected from the group consisting of cementitious material, leveling board and leveling layer sheet to a corrugated steel deck;

applying a sound reduction mat or board over the first layer, wherein the sound reduction mat comprises a member of the group consisting of a polyethylene core and nylon filaments forming a three dimensional core, and the sound reduction board comprises man-made vitreous fiber;

applying a second layer of cementitious material over the sound reduction mat or board and separated from the first lower leveling layer, the second layer having an upper and opposed lower surface, wherein the sound reduction mat or board is under and contacts the entire lower surface of the second upper layer to completely separate and prevent contact between the first lower leveling layer and the second layer to provide decoupling of acoustic sound transmission between the first lower leveling layer and the second layer, and wherein the first lower layer extends about 0.015 to 1.5 inches (0.04-3.8 cm) above a flute of the corrugated steel deck, and sufficient mat or board is provided to increase the IIC rating of the assembly by >7 IIC points above that of the assembly in the absence of the mat or board, wherein the second upper layer has a thickness of about 0.25 inches to 3 inches, wherein the perimeters of the sound reduction layer, and second layer, are surrounded by perimeter isolation strips in order to separate the sound reduction layer and the second layer of cementitious material from a vertically extending wall installed on the lower leveling layer on the corrugated steel deck.

23. The method of claim 22, wherein the first lower layer comprises cementitious material and has reinforcement selected from the group consisting of continuous strands chopped and cut fibers and wherein the reinforcement is made of a member of the group consisting of alkali resistant glass, steel, carbon fibers and aramid strand.

24. The method of claim 22, wherein the second upper layer comprises cementitious material and has reinforcement selected from the group consisting of continuous strands chopped and cut fibers and the reinforcement is made of a member of the group consisting of alkali resistant glass, steel, carbon fibers and aramid strand.

25. The method of claim 22, wherein the first lower leveling layer comprises the leveling board applied over the corrugated steel deck; and the leveling layer has a thickness of about 0.15 to 1.5 inches above the flute of the corrugated steel deck, and wherein the corrugated steel deck does not have ribs containing a cementitious material.

26. The method of claim 22, wherein the floor system has an IIC rating of at least 25 and the corrugated steel deck provides at least 50 percent of ultimate load carrying capacity under static and impact loading of the floor system with a floor deflection of at most 1/360 of floor span.

27. The method of claim 22, wherein the floor system has an IIC rating of at least 30 and the corrugated steel deck provides at least 70 percent of ultimate load carrying capacity under static and impact loading of the floor system with a floor deflection of at most 1/360 of floor span and the sound reduction layer is the sound reduction mat, and the mat is selected from the group consisting of mat having a core of nylon filaments attached to a nonwoven fabric and mat made of the polyethylene core and polypropylene fabric.

28. The method of claim 22, wherein the floor system has an IIC rating of at least 30 and the corrugated steel deck provides at least 90 percent of ultimate load carrying capacity under static and impact loading of the floor system with a floor deflection of at most 1/360 of floor span and the sound reduction layer is the sound reduction board and the sound reduction board comprises slag wool fiber and minerals.

29. The method of claim 22, wherein the first lower layer has a thickness of about 0.15 to 3/8 inches above a flute of the corrugated steel deck.

30. The method of claim 22, wherein the first lower layer has a thickness of about 0.15 to 1/4 inches above a flute of the corrugated steel deck.

31. A floor system in a building comprising:

a corrugated steel deck;

a sound reduction board for decoupling acoustic sound transmission between the corrugated deck and an upper layer, the sound reduction board applied over the entire upper surface of the corrugated steel deck in direct contact with the deck;

the upper layer of cementitious material applied over the sound reduction board and separated from the corrugated steel deck so the board is under and contacts an entire lower surface of the upper layer and there is no contact between the corrugated steel deck and the upper layer;

wherein the upper layer of cementitious material has a thickness of up to about 1.5 inches (3.8 cm), wherein the sound reduction board comprises man made vitreous fiber and wherein sufficient amount of the board is provided to increase IIC rating of the system by <7 IIC points above that of the system in the absence of the board, and wherein the perimeters of the sound reduction layer, and upper cementitious layer, are surrounded by perimeter isolation strips in order to separate the sound reduction board and the upper layer of cementitious material from a vertically extending wall to be installed on the corrugated steel deck.

32. The system of claim 31, wherein the floor system has an IIC rating of at least 25 and the corrugated steel deck provides at least 50 percent of ultimate load carrying capacity under static and impact loading of the floor system with a floor deflection of at most 1/360 of floor span and a board thickness of 0.015 to 1.5 inches (0.004 to 3.8 cm).

33. The system of claim 31, wherein the floor system has an IIC rating of at least 30 and the corrugated steel deck provides at least 70 percent of ultimate load carrying capacity under static and impact loading of the floor system with a floor deflection of at most 1/360 of floor span and the sound reduction board comprises slag wool fiber and minerals.

34. The system of claim 31, wherein the floor system has an IIC rating of at least 30 and the corrugated steel deck provides at least 90 percent of ultimate load carrying capacity under static and impact loading of the floor system with a floor deflection of at most 1/360 of floor span.

35. A method of construction of a floor system in a building, comprising:

applying a sound reduction board directly over the upper surface of a corrugated steel deck;

applying an upper layer of cementitious material over the sound reduction board and separated from the corrugated steel deck so the board is under and contacts an entire lower surface of the upper layer and there is no contact between the corrugated steel deck and the upper layer, and applying perimeter isolation strips surrounding the perimeters of the sound reduction board and upper layer in order to separate the sound reduction board and upper layer of cementitious material from a vertically extending wall installed on the corrugated steel deck;

wherein the sound reduction board provides decoupling of acoustic sound transmission between the corrugated steel deck and the layer of cementitious material, and wherein the upper layer of cementitious material has a thickness of at most about 1.5 inches (3.8 cm) and the sound reduction board comprises slag wool fiber and minerals.

36. The system of claim 1, wherein the floor system has an IIC rating of at least 30 and the corrugated steel deck provides at least 90 percent of ultimate load carrying capacity under static and impact loading of the floor system with a floor deflection of at most 1/360 of floor span.

37. The system of claim 31, wherein the floor system has an IIC rating of at least 30 and the corrugated steel deck provides at least 90 percent of ultimate load carrying capacity under static and impact loading of the floor system with a floor deflection of at most 1/360 of floor span.

* * * * *